US009127480B2

(12) United States Patent
Mathachan

(10) Patent No.: US 9,127,480 B2
(45) Date of Patent: Sep. 8, 2015

(54) LOCK CYLINDER AND KEY COMBINATION

(75) Inventor: Sajil J. Mathachan, Karnataka (IN)

(73) Assignee: Schlage Lock Company LLC, Indianapolis, IN (US)

( * ) Notice: Subject to any disclaimer, the term of this patent is extended or adjusted under 35 U.S.C. 154(b) by 241 days.

(21) Appl. No.: 13/504,314

(22) PCT Filed: Oct. 30, 2009

(86) PCT No.: PCT/US2009/062837

§ 371 (c)(1),
(2), (4) Date: Jun. 13, 2012

(87) PCT Pub. No.: WO2011/053317

PCT Pub. Date: May 5, 2011

(65) Prior Publication Data

US 2012/0240645 A1 Sep. 27, 2012

(51) Int. Cl.
*E05B 27/00* (2006.01)
*E05B 19/00* (2006.01)

(52) U.S. Cl.
CPC ..... *E05B 27/0078* (2013.01); *E05B 19/0052* (2013.01); *Y10T 70/7593* (2015.04); *Y10T 70/7864* (2015.04)

(58) Field of Classification Search
CPC ..... E05B 19/0052; E05B 27/0042; E05B 19/0023; E05B 27/00; E05B 27/0017; E05B 27/0078; E05B 19/0058; E05B 19/0017; E05B 27/086
USPC ..... 70/356, 490–493, 378, 409
See application file for complete search history.

(56) References Cited

U.S. PATENT DOCUMENTS

| | | | | |
|---|---|---|---|---|
| 1,456,584 A | | 5/1923 | Bell | |
| 2,023,207 A | * | 12/1935 | Olson | 70/406 |
| 2,079,628 A | * | 5/1937 | Olson | 70/492 |
| 2,155,734 A | * | 4/1939 | Olson | 70/358 |
| 2,358,164 A | | 9/1944 | Honger | |

(Continued)

FOREIGN PATENT DOCUMENTS

| | | |
|---|---|---|
| AT | 392508 B | 4/1991 |
| EP | 0237172 A2 | 9/1987 |

OTHER PUBLICATIONS

International Search Report dated Jun. 22, 2010 of PCT/US2009/062837, filed Oct. 30, 2009.

(Continued)

*Primary Examiner* — Suzanne Barrett
(74) *Attorney, Agent, or Firm* — Michael Best & Friedrich LLP

(57) ABSTRACT

A key and a lock cylinder (10) combination including a key and a lock cylinder having a housing and a plug. The key (25) includes a blade that has a first pin groove (210) on a first lateral side defining a first pin surface, and a second pin groove (215) on the first lateral side defining—a second pin surface. The lock cylinder also includes an auxiliary pin (115) with a first projection (135) defining a first engagement surface engageable by the first pin surface when the key is inserted into the key slot to move the auxiliary pin to a withdrawn position to allow rotation of the plug relative to the housing, and a second projection (140) defining a second engagement surface engageable by the second pin surface when the key is removed from the key slot to move the auxiliary pin to a projecting position to prevent rotation of the plug relative to the housing.

63 Claims, 16 Drawing Sheets

(56) References Cited

U.S. PATENT DOCUMENTS

| | | | | | |
|---|---|---|---|---|---|
| 2,375,682 | A | * | 5/1945 | Olson | 70/492 |
| 2,687,639 | A | | 8/1954 | Swanson | |
| 3,035,433 | A | | 5/1962 | Testa | |
| 3,137,156 | A | * | 6/1964 | Navarro | 70/492 |
| 3,264,852 | A | | 8/1966 | Gysin | |
| D274,302 | S | * | 6/1984 | Widen | D8/347 |
| 4,815,307 | A | | 3/1989 | Widen | |
| 4,977,767 | A | | 12/1990 | Prunbauer | |
| 5,067,335 | A | | 11/1991 | Widen | |
| 5,421,179 | A | * | 6/1995 | Bergstrom | 70/369 |
| 5,582,050 | A | * | 12/1996 | Haggstrom | 70/495 |
| 5,715,717 | A | | 2/1998 | Widen | |
| 5,809,816 | A | | 9/1998 | Widen | |
| 5,845,525 | A | | 12/1998 | Widen | |
| 6,134,929 | A | | 10/2000 | Widen | |
| 6,477,876 | B1 | * | 11/2002 | Kim | 70/495 |
| 7,159,424 | B2 | | 1/2007 | Widen | |
| 7,370,502 | B2 | | 5/2008 | Widen | |
| 7,487,653 | B2 | | 2/2009 | Widen | |
| 7,621,163 | B2 | * | 11/2009 | Widen | 70/493 |
| 8,156,777 | B1 | * | 4/2012 | Widen | 70/409 |
| 8,230,708 | B2 | * | 7/2012 | Widen | 70/409 |
| 8,281,628 | B2 | * | 10/2012 | Widen | 70/409 |
| 2006/0236733 | A1 | | 10/2006 | Baumhauer | |
| 2009/0241620 | A1 | | 10/2009 | Field et al. | |

OTHER PUBLICATIONS

Written Opinion dated Jun. 22, 2010 of PCT/US2009/062837, filed Oct. 30, 2009.

First Office Action from the State Intellectual Property Office of China for Application No. 200980163242X dated Mar. 27, 2014 (13 pages).

First Office Action from the Australian Intellectual Property Office Application No. 2009354815 dated Mar. 31, 2014 (4 pages).

* cited by examiner

LOCK CYLINDER AND KEY COMBINATION

BACKGROUND

The present invention relates to a lock cylinder and key combination, and more particularly, the present invention relates to a lock cylinder that is mounted in a door and that includes a housing and a plug.

Generally, lock assemblies include a housing and a plug that form a lock cylinder and that define respective pin chambers to receive pin pairs. The pin pairs include outer pins substantially disposed within the housing, and inner pins disposed within the plug. Springs are often used to bias the pin pairs toward a key slot defined in the plug. More specifically, the springs are engaged with the outer pins, which in turn engage the inner pins and force the inner pins into the key slot. In the absence of a correct or proper key, the outer pins are partially disposed in the plug and block rotation of the plug within the housing.

The plug is rotatable relative to the housing in most conventional lock assemblies. A shear line is defined where the plug and the housing come together. When a proper or appropriate key is inserted into the key slot, the inner pins are moved and, as a result, move the respective outer pins. The ends where the inner pins and the outer pins contact each other are aligned with the shear line upon insertion of the proper key, and allow the plug to be turned to a locked or unlocked position. In other words, the proper key will move the inner and outer pins such that the outer pins are disposed completely in the housing, and the inner pins are disposed completely in the plug.

SUMMARY

In one construction, the invention provides a key and lock cylinder combination that includes a key having a bow and a blade extending from and connected to the bow. The blade defines a longitudinal axis along the length of the blade and is defined by a first lateral side and a second lateral side opposite the first lateral side. The blade has pin engaging portions at a top of the blade, a first pin groove on the first lateral side extending in the direction of the longitudinal axis and defining a first pin surface, and a second pin groove on the first lateral side extending in the direction of the longitudinal axis and defining a second pin surface. The first pin surface is oriented to face the top of the blade and the second pin surface is oriented to face a bottom of the blade such that the first pin surface and the second pin surface face in opposite directions. The key and lock cylinder combination also includes a housing, an outer pin, a plug, an inner pin, and an auxiliary pin. The housing includes a wall that defines a hollow portion, and a pin portion that defines an outer pin chamber. The outer pin is disposed in the outer pin chamber. The plug includes a body rotatably housed within the hollow portion of the housing, and the housing and the plug cooperate to define a shear line. The plug defines a key slot extending at least partially through the body in a longitudinal direction of the plug, and the plug further defines an inner pin chamber disposed within the body and in communication with the key slot, and an auxiliary pin chamber in communication with the key slot. The inner pin chamber is selectively aligned with the outer pin chamber. The inner pin is disposed in the inner pin chamber and extends partially into the key slot such that the inner pin is engageable by the pin engaging portions. The auxiliary pin is disposed in the auxiliary pin chamber and is in communication with the key slot. The auxiliary pin includes a first projection defining a first engagement surface that is engageable by the first pin surface when the key is inserted into the key slot to move the auxiliary pin to a withdrawn position to allow rotation of the plug relative to the housing, and a second projection spaced apart from the first projection and defining a second engagement surface that generally faces the first engagement surface and that is engageable by the second pin surface when the key is removed from the key slot to move the auxiliary pin to a projecting position in which the auxiliary pin projects from the plug and is engageable with the housing to prevent rotation of the plug relative to the housing.

In another construction, the invention provides a key and lock cylinder combination including a key, a housing, an outer pin, a plug, an inner pin, and an auxiliary pin. The key includes a bow and a blade extending from and connected to the bow, and the blade defines a longitudinal axis along the length of the blade. The blade is defined by a first lateral side and a second lateral side opposite the first lateral side. The blade has pin engaging portions at a top of the blade, a first pin surface extending in the direction of the longitudinal axis on the first lateral side, and a second pin surface extending in the direction of the longitudinal axis on the first lateral side. The first pin surface and the second pin surface are oriented to face in opposite directions, and each of the first pin surface and the second pin surface and has an increase in elevation toward the bow when the longitudinal axis is horizontal. The housing includes a wall defining a hollow portion, and a pin portion defining an outer pin chamber. The outer pin is disposed in the outer pin chamber. The plug includes a body rotatably housed within the hollow portion of the housing, and the housing and the plug cooperate to define a shear line. The plug defines a key slot extending at least partially through the body in a longitudinal direction of the plug, and the plug further defines an inner pin chamber disposed within the body and in communication with the key slot and selectively aligned with the outer pin chamber. The auxiliary pin chamber is in communication with the key slot and offset from the key slot. The inner pin is disposed in the inner pin chamber and extends into the key slot such that the inner pin is engageable by the pin engaging portions. The auxiliary pin is disposed in the auxiliary pin chamber and is in communication with the key slot and engaged by the first pin surface upon insertion of the key into the key slot to move the auxiliary pin to a withdrawn position to allow rotation of the plug relative to the housing. The auxiliary pin also is engaged by the second pin surface upon removal of the key from the key slot to move the auxiliary pin to a projecting position in which the auxiliary pin projects from the plug and is engageable with the housing to prevent rotation of the plug relative to the housing.

In yet another construction, the invention provides a lock cylinder including a housing that has a wall defining a hollow portion, and a pin portion defining at least two outer pin chambers. The lock cylinder also includes outer pins disposed in each of the outer pin chambers, a plug that has a body rotatably housed within the hollow portion of the housing, inner pins, and an auxiliary pin. The housing and the plug cooperate to define a shear line, and the plug defines a key slot extending at least partially through the body in a longitudinal direction of the plug. The plug further defines at least two inner pin chambers disposed within the body and in communication with the key slot and selectively aligned with the outer pin chambers, and an auxiliary pin chamber in communication with the key slot. The inner pins are disposed in each of the inner pin chambers and extend partially into the key slot such that the inner pins are engageable by a key. The auxiliary pin is disposed in the auxiliary pin chamber and is in communication with the key slot, and the auxiliary pin includes a first projection defining a first engagement surface and a second projection defining a second engagement surface. The first engagement surface is engageable by a key to move the auxiliary pin to a withdrawn position to allow rotation of the plug relative to the housing. The second engagement surface generally faces the first engagement surface and is engageable by the key to move the auxiliary pin to a projecting position in which the auxiliary pin projects from the plug and is engageable with the housing to prevent rotation of the plug relative to the housing.

In yet another construction, the invention provides a key for a lock cylinder. The key includes a bow and a blade extending from and connected to the bow. The blade defines a longitudinal axis along the length of the blade and is defined by a first lateral side and a second lateral side opposite the first lateral side. The blade has pin engaging portions at a top of the blade, a first pin groove that extends in the direction of the longitudinal axis on the first lateral side and that defines a first pin surface, and a second pin groove that extends in the direction of the longitudinal axis on the first lateral side and that defines a second pin surface. The first pin surface is oriented to face the top of the blade and the second pin surface is oriented to face a bottom of the blade such that the first pin surface and the second pin surface face in opposite directions. Each of the first pin surface and the second pin surface is engageable with a pin of the lock cylinder to move the pin between a withdrawn position and a projecting position.

In yet another construction, the invention provides a key for a lock cylinder. The key includes a bow and a blade extending from and connected to the bow. The blade defines a longitudinal axis along the length of the blade and is defined by a first lateral side and a second lateral side opposite the first lateral side. The blade has pin engaging portions at a top of the blade, a first pin surface extending in the direction of the longitudinal axis on the first lateral side and oriented to face the top of the blade, and a second pin surface extending in the direction of the longitudinal axis on the first lateral side and oriented to face a bottom of the blade such that the first pin surface and the second pin surface face in opposite directions. Each of the first pin surface and the second pin surface has an increase in elevation toward the bow when the longitudinal axis is horizontal such that a pin of the lock cylinder is movable to a withdrawn position upon insertion of the key into the lock cylinder, and is movable to a projecting position upon removal of the key from the lock cylinder.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
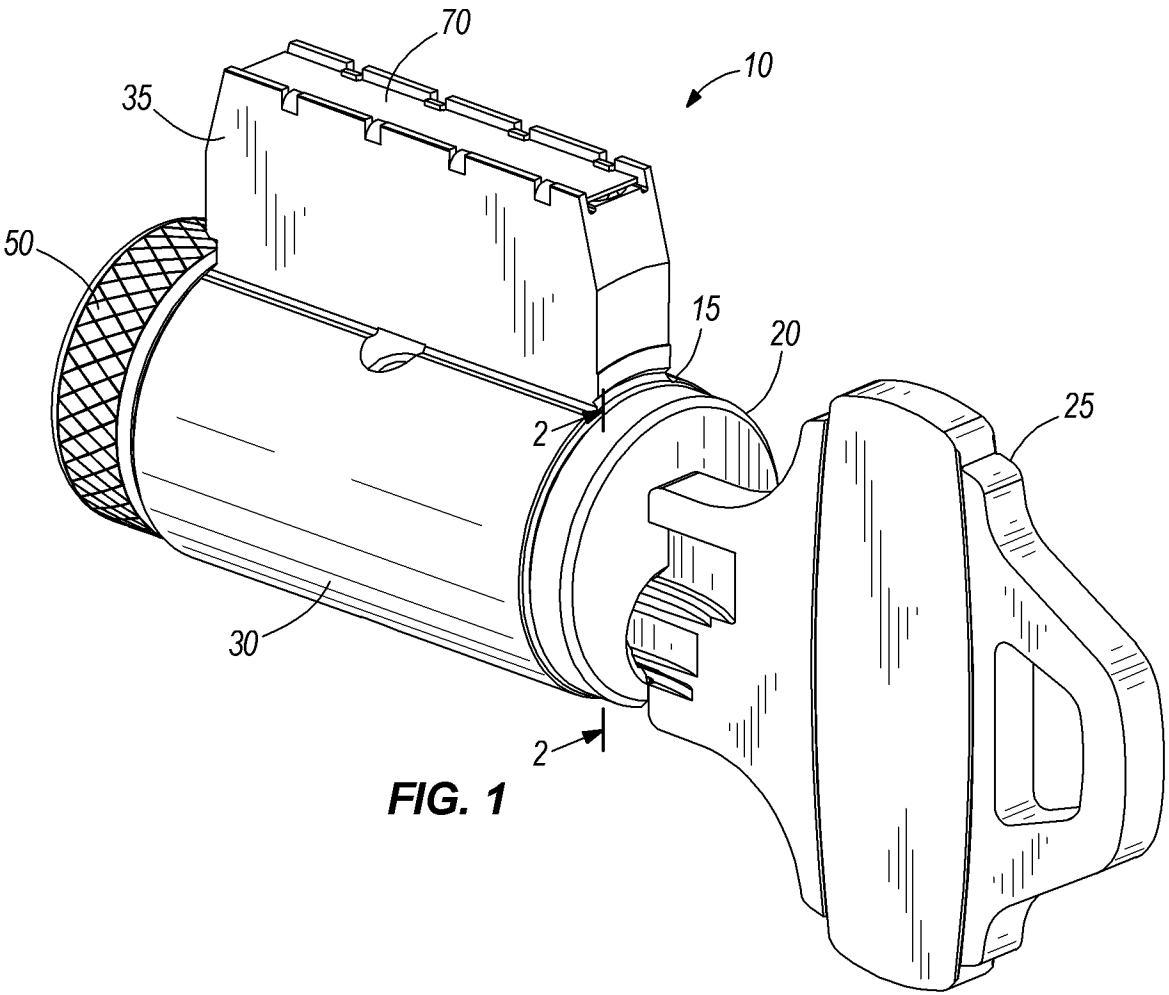
FIG. 1 is a perspective view of a key and lock cylinder combination including a housing, a plug, and a key embodying the invention.

FIG. 1 shows a lock cylinder 10 for use with structures (e.g., doors, access panels, portable locks, etc.) that may be locked and unlocked. Hereinafter, the term "door" shall be used to represent all such lockable structures and shall not be construed to limit the invention's application solely to doors.

The lock cylinder 10 includes a housing 15 and a plug 20 that is selectively rotatable within the housing 15 using a key 25.

Figure 2:
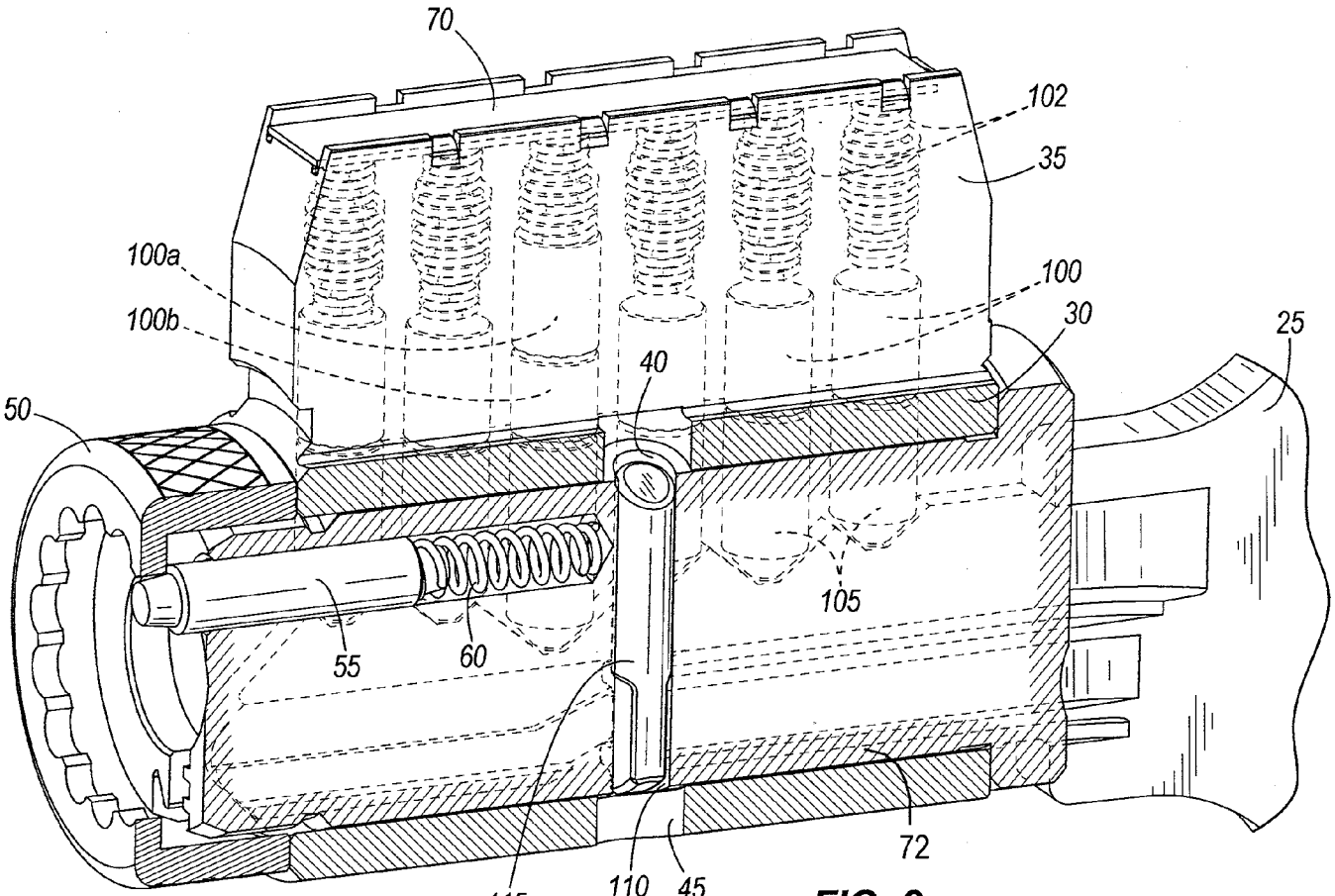
FIG. 2 is a partial cross-section view of the lock cylinder of FIG. 1 including the housing, the plug, the key, and an auxiliary pin.
Figure 3:
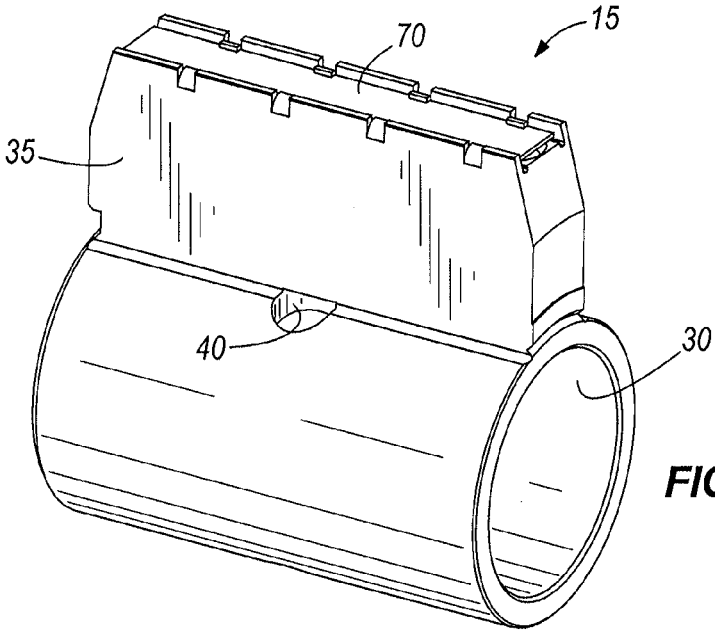
FIG. 3 is a perspective view of the housing.
Figure 4:
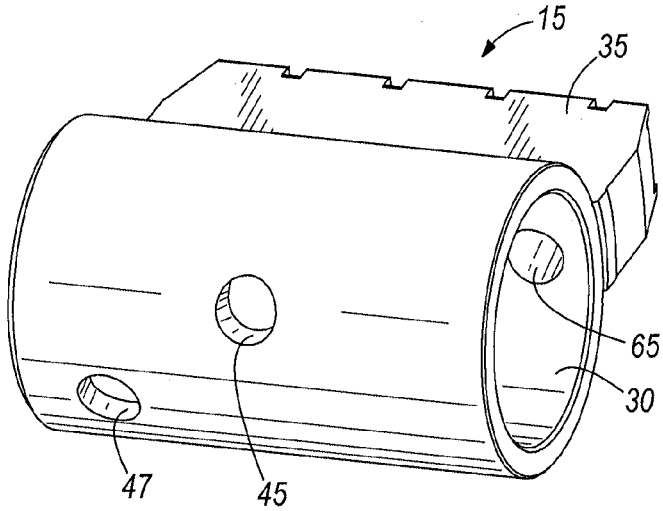
FIG. 4 is another perspective view of the housing.
Figure 5:
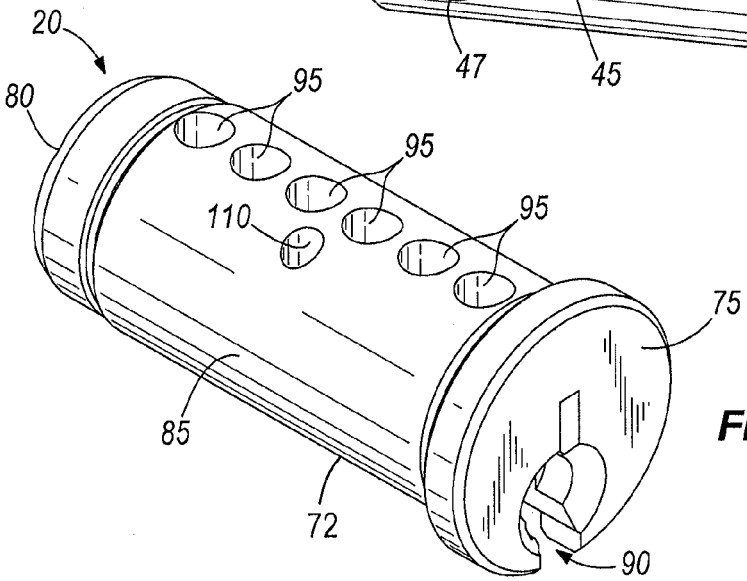
FIG. 5 is a perspective view of the plug.

As shown in FIGS. 1-4, the housing 15 includes a wall 30 and a pin portion 35. The wall 30 is substantially cylindrical and defines a hollow portion that is configured to receive the plug 20. FIGS. 3 and 4 show that the housing 15 includes a first passageway 40 radially offset from the pin portion 35 and extending through the wall 30, a second passageway 45 opposite the first passageway 40, and a third passageway 47 extending through the wall 30. The first passageway 40 and the second passageway 45 are aligned with each other and are in communication with the plug 20 after assembly of the plug 20 into the housing 15. The third passageway 47 is aligned with another passageway (not shown) on an opposite portion of the wall for selectively receiving an undercut pin (not shown) that is movable into and out of engagement with the housing 15 by the key 25.

The housing 15 is typically fixed relative to the door, and the plug 20 is movable relative to the housing 15 between a locked position and an unlocked position. The plug 20 is typically connected to a driver bar (not shown) or other structure via a retainer or screw cap 50 and an alignment pin 55 biased by a spring 60 (FIG. 2) for moving a latch relative to the door to lock or unlock the door. Such arrangements are well known in the art.

As shown in FIGS. 1-3 and 12-14, the pin portion 35 extends above the wall 30 and includes first or outer pin chambers 65. The outer pin chambers 65 are accessible through a removable member 70 adjacent the outer end of the pin portion 35. In the illustrated construction, the pin portion 35 includes six outer pin chambers 65, but fewer or more outer pin chambers 65 are within the scope of the invention.

Figure 12:
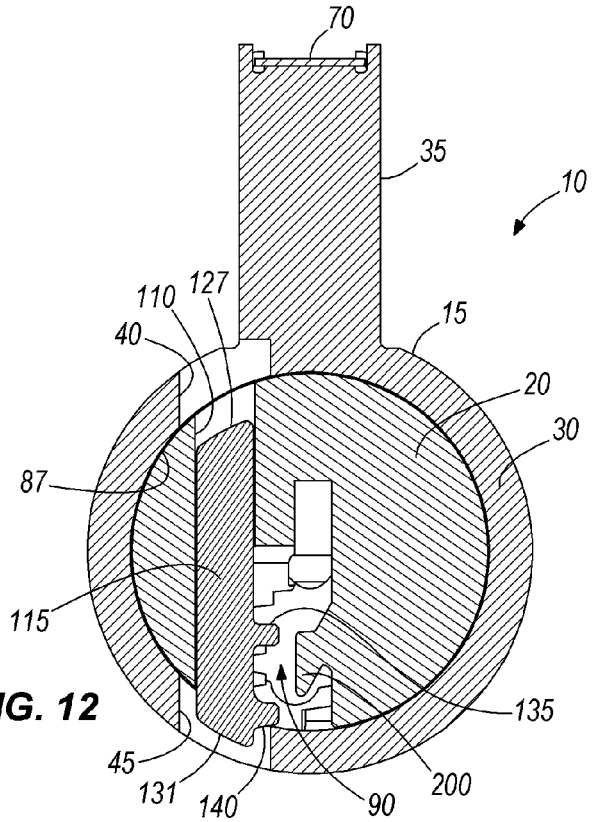
FIG. 12 is a section view of the lock cylinder without the key.
Figure 13:
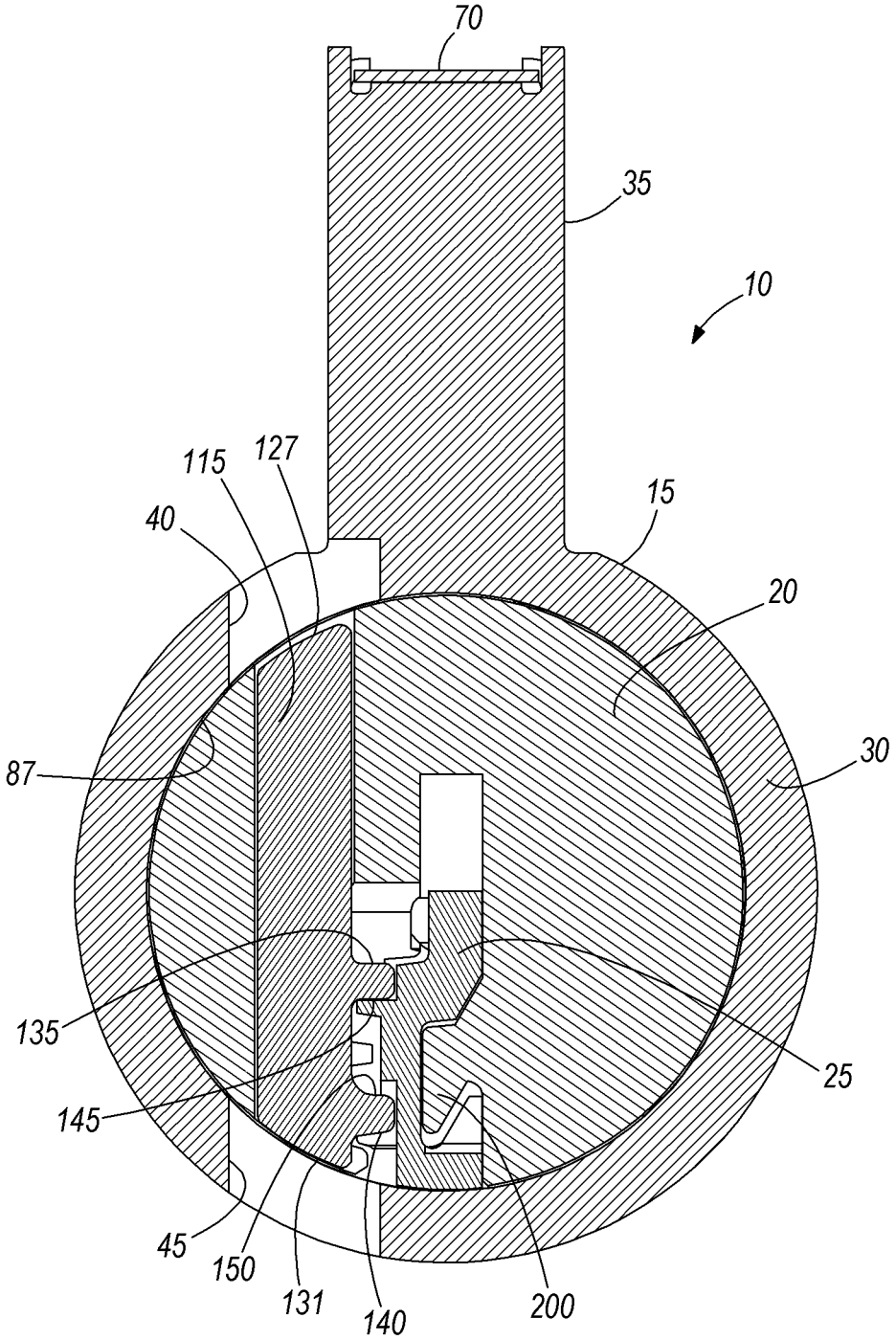
FIG. 13 is the view of FIG. 12 with the key inserted into the key slot.

FIGS. 1, 2, 5, and 6 show that the plug 20 includes a body 72 rotatable relative to the hollow portion of the housing 15. The body 72 is defined by a first end 75, a second end 80, and an outer surface 85. The first end 75 is accessible from the front of the lock cylinder 10. The second end 80 is accessible from the rear of the lock cylinder 10. As shown in FIGS. 12 and 13, the wall 30 and the outer surface 85 of the plug 20 cooperate to define a shear line 87.

Figure 14:
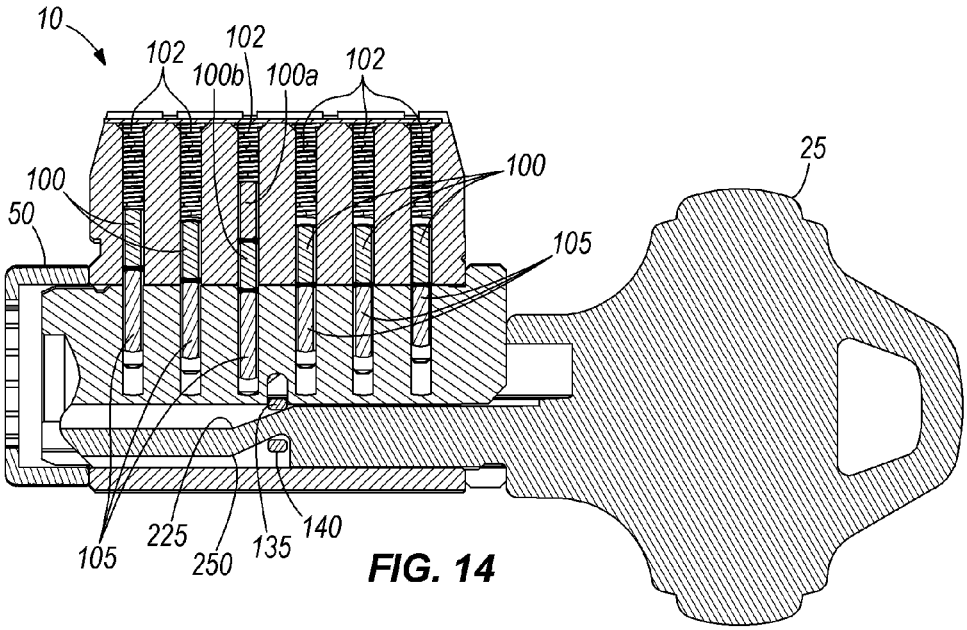
FIG. 14 is a section view of the lock cylinder and the key taken along the longitudinal axis of the key.

The plug 20 also includes a key slot 90 and second or inner pin chambers 95. The key slot 90 extends longitudinally through the body 72 from the first end 75 toward the second end 80, and is further accessible from adjacent the first end 75. FIG. 14 shows that the inner pin chambers 95 extend from the outer surface 85 of the body 72 toward the key slot 90 substantially transverse to the key slot 90. The inner pin chambers 95 are in communication with the key slot 90, and are further selectively aligned with respective outer pin chambers 65 upon insertion of the plug 20 into the housing 15. Thus, FIG. 14 shows that the plug 20 includes six inner pin chambers 95, although in other constructions the quantity of inner pin chambers 95 may be different from the quantity of outer pin chambers 65. While the inner and outer pin chambers 65, 95 are shown as substantially cylindrical chambers, they can have other shapes (e.g., rectangular, etc.) that are within the scope of the invention.

FIGS. 2 and 14 show that the pin portion 35 further includes a respective first or outer pin 100 disposed within each of the outer pin chambers 65. The outer pins 100 are configured to move in a first or inward direction (downward in FIG. 14) into the plug 20, and in a second or outward direction (upward in FIG. 14) away from the plug 20. The outer pins 100 extend partially into the respective inner chambers 95, as shown in FIG. 12, when the plug 20 is in the locked position and a proper key is not inserted into the slot 90. In the illustrated embodiment, the pin portion 35 also include springs 102 to bias the outer pins 100 inward. In some embodiments, the outer pins 100 can move inward without engagement by springs 60 due to orientation of the pin portion 35 above the plug 20 (i.e., inward movement is assisted by gravity). As shown in FIGS. 2 and 14, one or more of the outer pins 100 can be master key pins 100*a*, 100*b* that allow more than one key to lock and unlock the lock cylinder 10.

FIGS. 2 and 14 show that a respective second or inner pin 105 is disposed within each of the inner pin chambers 95. Each inner pin 105 can have a length that is the same as or different from the length of the other inner pins 105. Each of the inner pins 105 is selectively engaged with the respective outer pin 100, and extends into the key slot 90. Generally, the quantity of inner pins 105 will be the same as the quantity of outer pins 100.

In the illustrated construction, the pin portion 35 includes six outer pins 100 and six inner pins 105. However more or fewer outer pins 100 and inner pins 105 may be possible and are within the scope of the invention. For example, commercial applications of the plug 20 usually include six outer and inner pins 100, 105, respectively, in accordance with established industry practices. However, residential applications of the plug 20 usually have settled on five outer and inner pins 100, 105, respectively. In these residential applications, the plug 20 may include five outer pins 100 and inner pins 105 in five corresponding outer and inner pin chambers 65, 95, even though the plug 20 may have six or more outer and inner pin chambers 65, 95. The remaining outer and inner pin chambers 65, 95 may be unused in residential applications. The invention described herein incorporates both commercial and residential applications of the lock cylinder 10, and should not be limited to only one such application.

Figure 6:
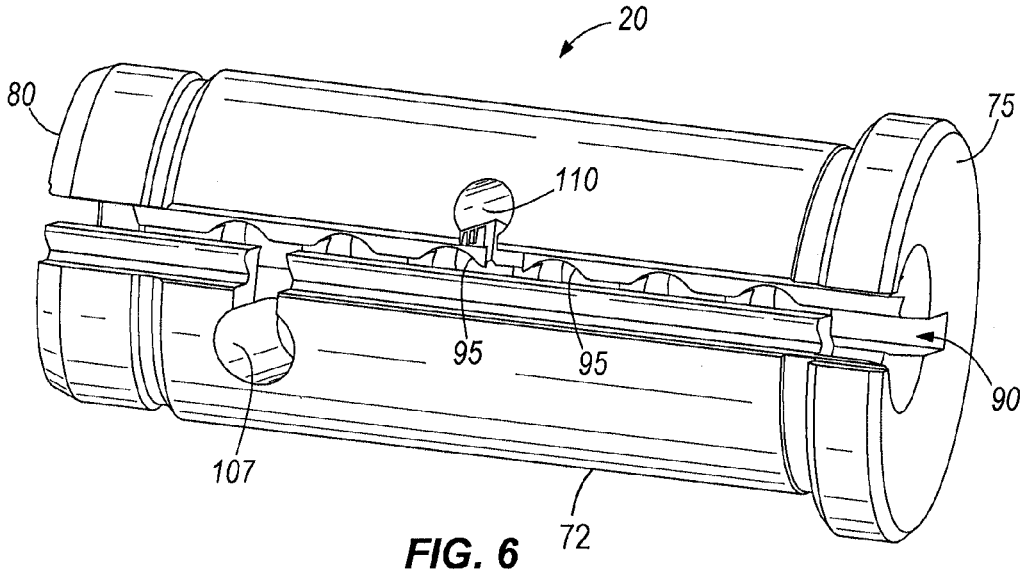
FIG. 6 is another perspective view of the plug.

As shown in FIG. 6, the plug 20 further includes an undercut passageway 107 for receiving an undercut pin (not shown), and a bore or passageway or auxiliary pin chamber 110 that extends through the body 72 and that is parallel to the inner pin chambers 95. In the illustrated construction, the auxiliary pin chamber 110 is offset from the key slot 90 in a lateral direction of the plug 20, and is positioned between two inner pin chambers 95. In other words, the auxiliary pin chamber 110 is offset from an adjacent inner pin chamber 95 in a longitudinal direction of the plug 20. In other constructions, the auxiliary pin chamber 110 can be aligned with one inner pin chamber 95 in the longitudinal direction of the plug 20.

Figure 17:
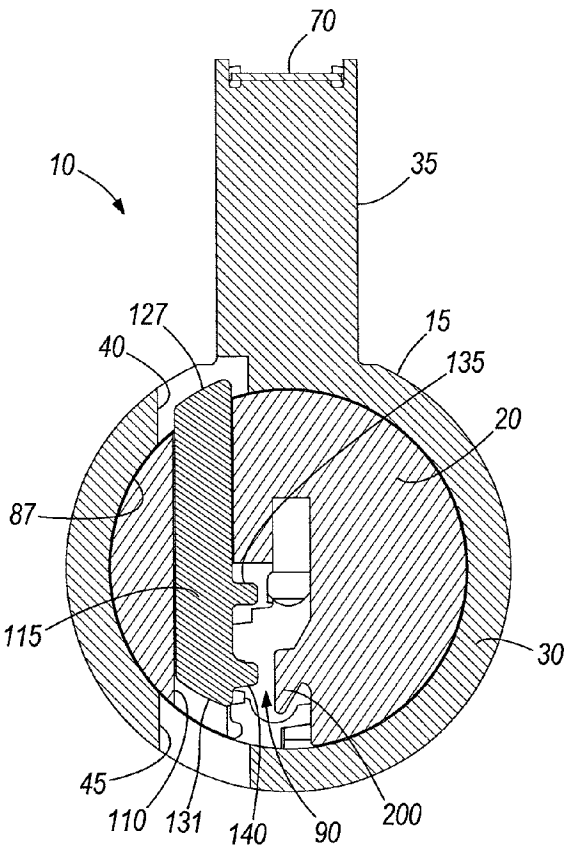
FIG. 17 is the view of FIG. 12 with the auxiliary pin in a bumped position.

FIGS. 12, 13, and 17 show that the auxiliary pin chamber 110 is in direct communication with the key slot 90. The illustrated plug 20 includes one auxiliary pin chamber 110, although more than one auxiliary pin chamber 110 is possible and considered herein. For example, other constructions may include auxiliary pin chambers similar to the auxiliary pin chamber 110 and auxiliary pins similar to the auxiliary pin 115 but disposed on the opposite side of the key as the auxiliary pin chamber 110 illustrated in FIG. 12. In addition, other constructions could include additional auxiliary pin chambers and auxiliary pins located on the same side of the key as the auxiliary pin chamber 110 but in a different axial position (e.g., further into the cylinder 10 or closer to the cylinder face). Thus, constructions could include two or more auxiliary pins located on one or both sides of the key, as desired. While the illustrated auxiliary pin chamber 110 is cylindrical, the auxiliary pin chamber 110 can have other shapes.

As shown in FIGS. 2, 12-14, and 17, a third or auxiliary pin 115 is disposed in the auxiliary pin chamber 110 and is in communication with the key slot 90 for engagement by the key 25 to move the auxiliary pin 115 between a projecting position (FIG. 12) and a withdrawn position (FIG. 13). In the projecting position, the auxiliary pin 115 projects from the plug 20 into the second passageway 45 and is engageable with the housing 15 to prevent rotation of the plug 20 relative to the housing 15. In the withdrawn position, the auxiliary pin 115 is lifted and positioned in the plug 20 so that the auxiliary pin 115 clears the shear line 87 or is completely within the plug 20 to allow rotation of the plug 20 relative to the housing 15. The auxiliary pin 115 is movable upward and downward (as viewed in FIGS. 12 and 13) relative to the housing 15 and the plug 20, and is unbiased and movable by the key 25 without a bias or spring force. In some constructions, a biasing member (e.g., a spring) could be positioned to bias the auxiliary pin 115 toward the key 25. As illustrated in FIGS. 12, 13, and 17, the auxiliary pin 115 can cross the shear line 87 in two places (i.e., the auxiliary pin 115 can enter either of the first and second passageways 40, 45).

Figure 7A:
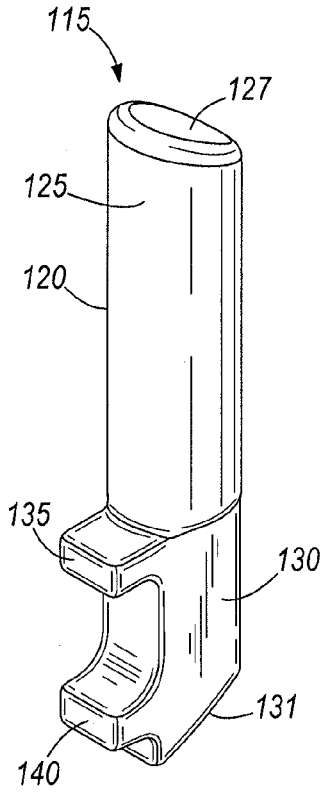
FIG. 7A is a perspective view of the auxiliary pin.
Figure 7B:
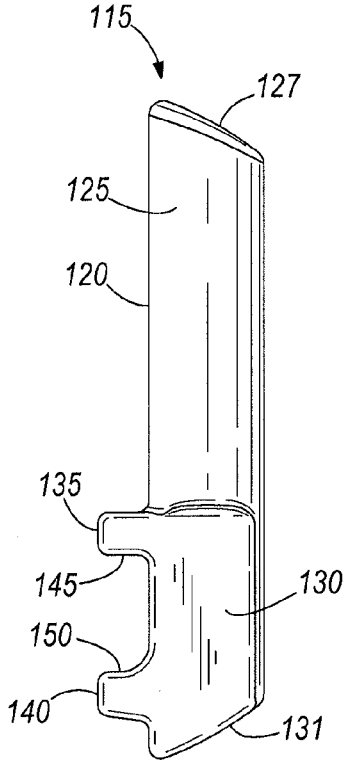
FIG. 7B is a side view of the auxiliary pin.
Figure 7C:
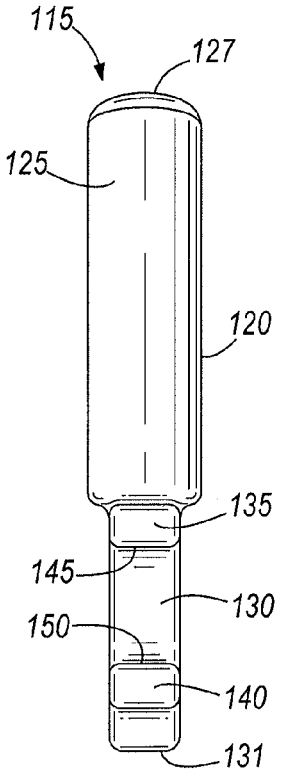
FIG. 7C is another side view of the auxiliary pin.
Figure 7D:
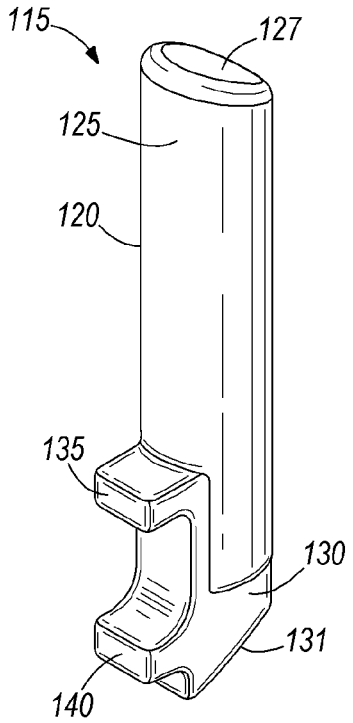
FIG. 7D is an alternative construction of the auxiliary pin.
Figure 7E:
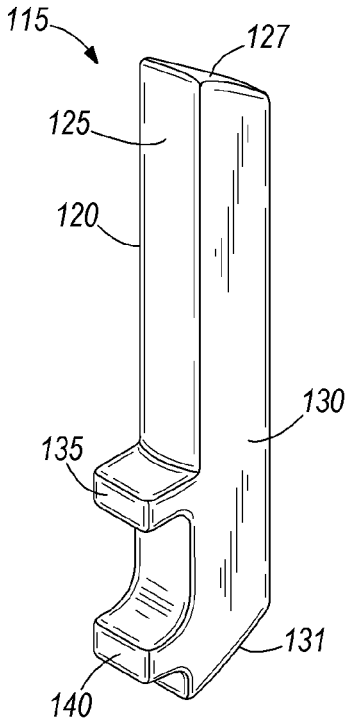
FIG. 7E is another alternative construction of the auxiliary pin.

FIGS. 7A-7J show that the auxiliary pin 115 includes an elongated body 120 including a substantially cylindrical upper portion 125 defining a first end 127 and a lower rectangular or planar portion 130 defining a second end 131. As illustrated in FIG. 7D, the upper and lower portions 125, 130 may be substantially cylindrical. As illustrated in FIG. 7E, the upper and lower portions 125, 130 may be substantially planar on opposite sides along the length of the body 120. In other constructions, the upper and lower portions 125, 130 may have other shapes.

Figure 7F:
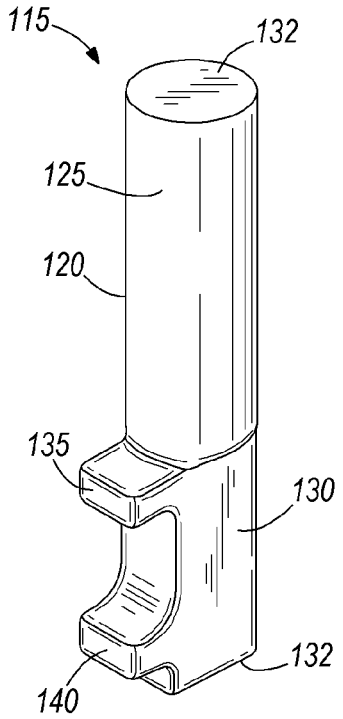
FIG. 7F is another alternative construction of the auxiliary pin.
Figure 7G:
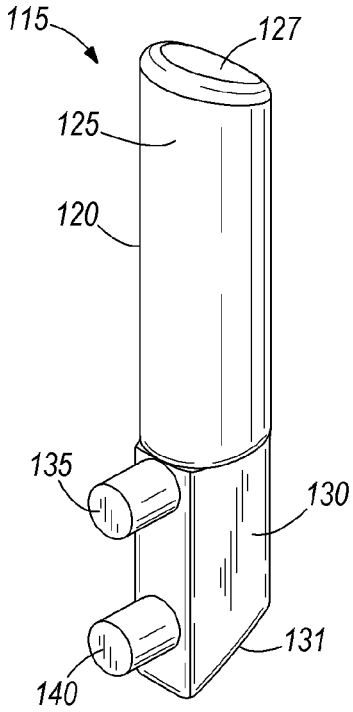
FIG. 7G is another alternative construction of the auxiliary pin.
Figure 7H:
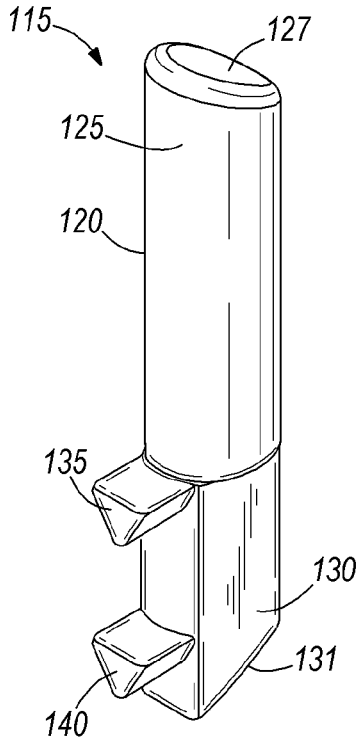
FIG. 7H is another alternative construction of the auxiliary pin.
Figure 7I:
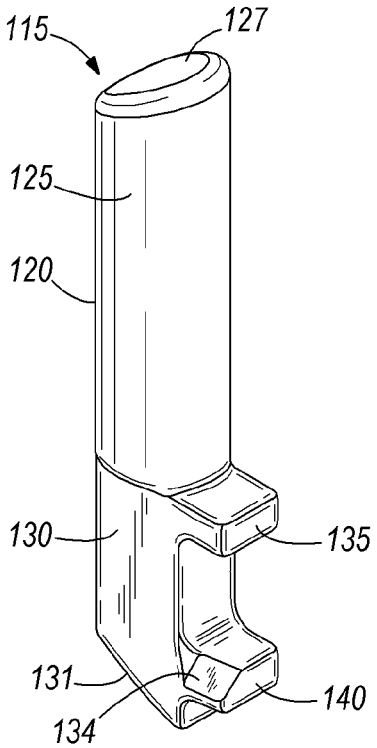
FIG. 7I is another alternative construction of the auxiliary pin.
Figure 7J:
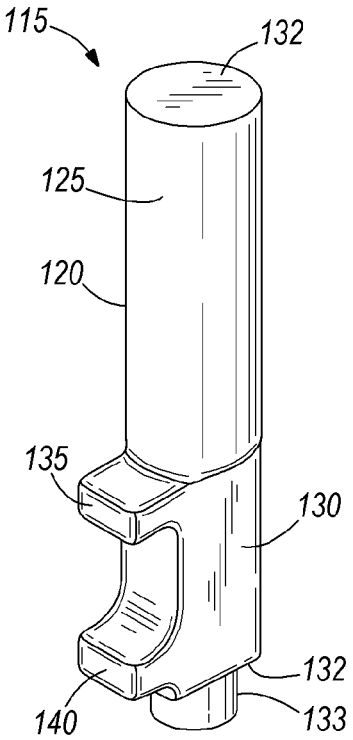
FIG. 7J is another alternative construction of the auxiliary pin.

As shown in FIGS. 7A-7E and 7G-7I, the first and second ends 127, 131 are shaped (e.g., partially curved) to substantially conform to the curvature of the outer surface 85 of the plug 20. As illustrated in FIGS. 7F and 7J, the first and second ends 127, 131 can include substantially planar surfaces 132. In other constructions, the first and second ends 127, 131 may have other shapes or surfaces. For example, FIG. 7J shows that the second end 131 includes a cylindrical protrusion 133 that extends outward from the body 120 and that is engageable with the second passageway 45 of the housing 15.

The auxiliary pin 115 also includes a first projection 135 and a second projection 140 spaced apart from the first projection 135 such that there is a void between the first and second projections 135, 140. As shown in FIGS. 7A-7I, 12, 13, and 17, each of the first projection 135 and the second projection 140 extends outward from the lower portion 130 and is projectable into the key slot 90. The first projection 135 defines a first engagement surface 145, and the second projection 140 defines a second engagement surface 150 that generally faces the first engagement surface 145. As shown in FIGS. 7A-7F and 7J, each of the first projection 135 and the second projection 140 includes a substantially rectangular cross-section such that the first and second engagement surfaces 145, 150 are substantially planar and parallel to each other.

In other constructions, the first and second projections 135, 140 may have other regular or irregular shapes. For example, as shown in FIG. 7G, the first projection 135 and the second projection 140 are cylindrically-shaped such that the first and second engagement surfaces 145, 150 are curved. As shown in FIG. 7H, the first projection 135 and the second projection 140 are triangularly-shaped such that the first engagement surface 145 is relatively narrow or almost linear (corresponding to the point of the triangular-shaped first projection 135), and the second engagement surface 150 is planar. FIG. 7I shows that the second projection 140 can include a chamfered surface 134 that extends outward from the body 120 and that is engageable by the key 25 upon insertion of the key 25 into the key slot 90.

Figure 8:
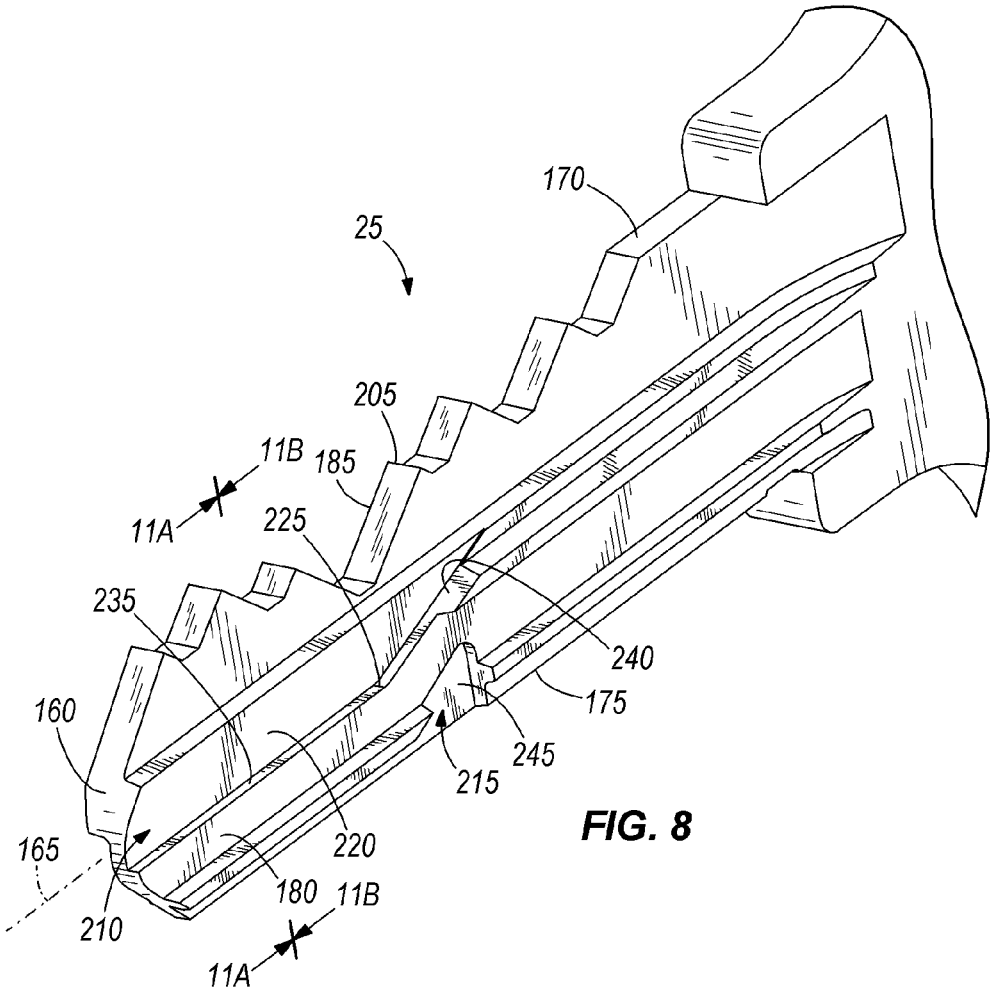
FIG. 8 is a perspective view of a blade of the key.
Figure 9:
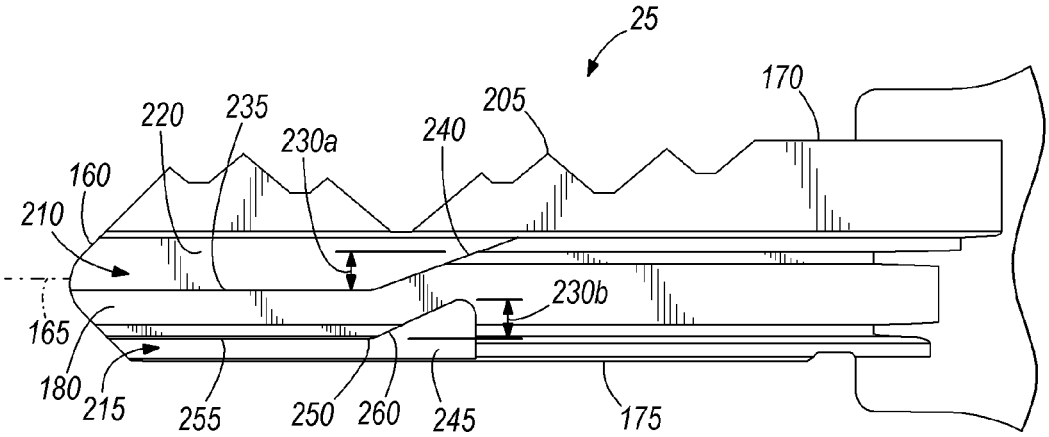
FIG. 9 is a side view of the blade of FIG. 8.
Figure 10:
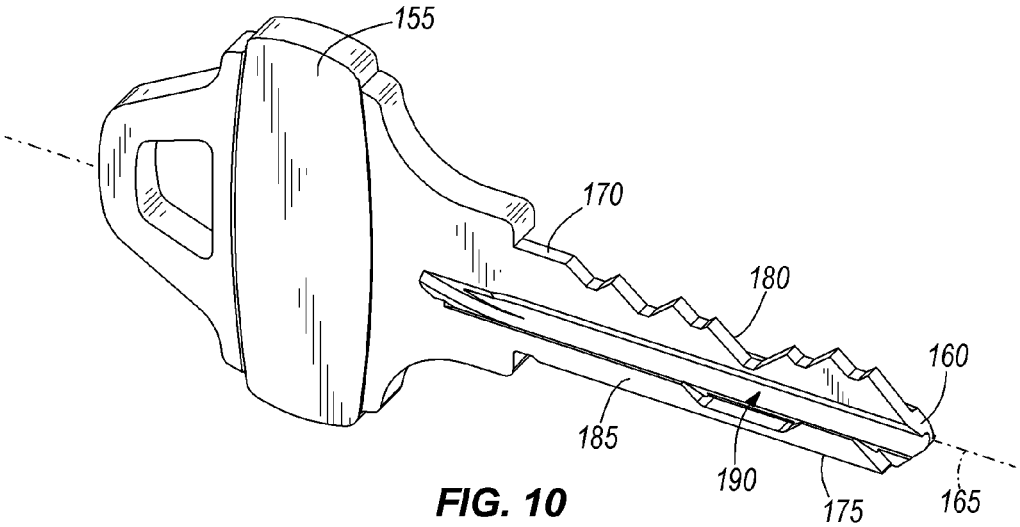
FIG. 10 is another perspective view of the key.

FIGS. 8-11B show that the key 25 includes a bow 155 and a blade 160 extending from the bow 155. The bow 155 forms a gripping portion that allows a user to hold and use the key 25. The blade 160 is insertable into the key slot 90, and extends from and is connected to the bow 155. As illustrated in FIGS. 8-10, the key 25 defines a longitudinal axis 165 that extends lengthwise along the blade 160. The blade 160 is defined by a top 170, a bottom 175, a first lateral side 180, and a second lateral side 185 that is opposite the first lateral side 180. As illustrated in FIGS. 8-11B, the longitudinal axis 165 is horizontal and the first and second lateral sides 180, 185 are vertical. Although the key 25 is described in detail with regard to this orientation, this frame of reference is not limiting. As one of ordinary skill in the art will recognize, the key 25 can be turned or oriented in other directions (e.g., turned 180 degrees such that the top 170 and the bottom 175 of the key 25 are reversed).

Figure 11A:
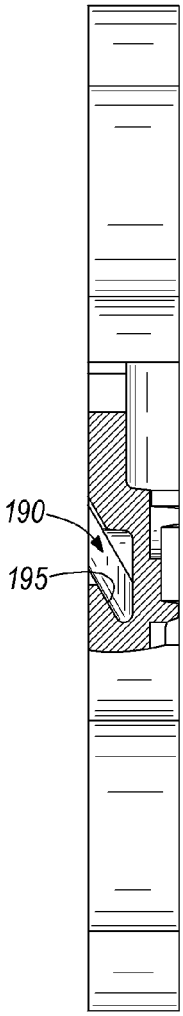
FIG. 11A is a section view of the key taken along line 11A-11A in FIG. 8.
Figure 11B:
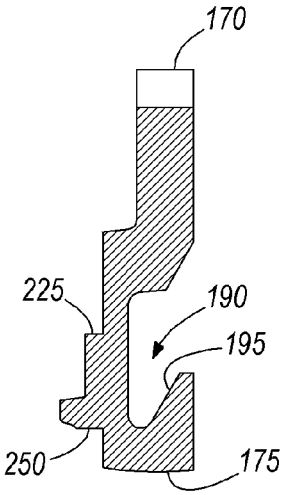
FIG. 11B is section view of the key of FIG. 1 taken along line 11B-11B in FIG. 8.

FIGS. 10 and 11A show that the blade 160 includes on the second lateral side 185 an undercut groove 190 that extends longitudinally along the blade 160. The undercut groove 190 is defined by an undercut surface 195 and is engageable with a portion 200 of the plug 20 (FIGS. 12 and 13) as is known in the art. In other constructions, the key 25 may be without the undercut groove 190.

Referring to FIGS. 8, 9, and 11A-B, the blade 160 includes pin engaging portions 205 located on the top 170 of the key 25, a first pin groove 210, and a second pin groove 215. In the illustrated construction, the first pin groove 210 and the second pin groove 215 are formed in the first lateral side 180 using a side bit milling process in which the side bit mill is oriented substantially perpendicular to the first lateral side 180. In other constructions, the first pin groove 210 and the second pin groove 215 may be formed using other manufacturing processes.

Figure 22:
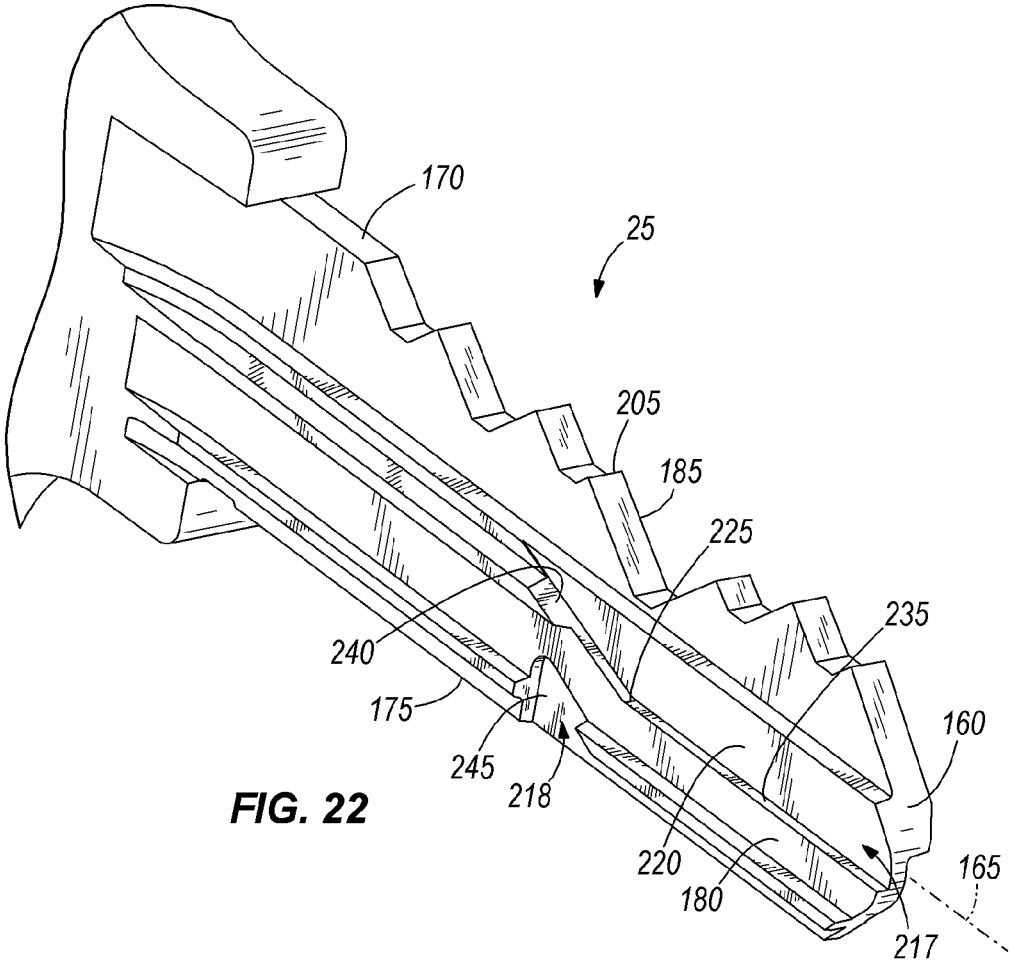
FIG. 22 is a perspective view of an alternative construction of the key of FIG. 1.

The first and second pin grooves 210 and 215 are generally non-wavelike grooves that extend in the direction of the longitudinal axis 165 on the first lateral side 180 without an acute undercut into the side of the key. In some constructions, the first lateral side 180 of the key 25 may include the one set of pin grooves (e.g., first and second pin grooves 210, 215) engageable with the auxiliary pin 115, and the second lateral side 185 of the key 25 may include another set of pin grooves engageable with another auxiliary pin similar to the auxiliary pin 115. For example, FIG. 22 shows that on the second lateral side 185, the key 25 includes a first pin groove 217 and a second pin groove 218 that are the same as and symmetrical to the first pin groove 210 and the second pin groove 215, respectively. In other constructions, the first pin groove 217 and the second pin groove 218 can be different from and function the same as the respective first and second pin grooves 210, 215. In the construction of FIG. 22, the key 25 does not include the undercut groove 190. Due to the similarities between the first pin grooves 210, 217 and the second pin grooves 215, 218, the first and second pin grooves 217, 218 will not be discussed in detail.

As shown in FIGS. 8 and 9, the first pin groove 210 extends in the direction of the longitudinal axis 165 on the first lateral side 180 and has a length that is shorter than the length of the blade 160 so that the key 25 can be properly aligned within the plug. Generally, the length of the first pin groove can be varied to alter the locking characteristics of the key and lock cylinder combination.

The first pin groove 210 defines a first blade surface 220 and a first pin surface 225. The first blade surface 220 extends vertically on the first lateral side 180 and is oriented to face outward from the blade 160. The first pin surface 225 is perpendicular to the first blade surface and is oriented to face the top 170 of the blade 160, and extends in the direction of the longitudinal axis 165. The first pin surface 225 has a change in elevation 230*a* when the longitudinal axis 165 is horizontal. Generally, the change in elevation 230*a* means that along the length of the first pin surface 225 from the tip of the key 25 toward the bow 155, the first pin surface 225 moves closer to the top 170 of the key 25 (i.e., the change in elevation 230*a* is an increase in elevation toward the bow 155). In other words, the first pin surface 225 is closer to the top 170 of the key 25 after the change in elevation 230*a*.

As shown in FIG. 9, the first pin surface 225 includes a first portion 235 that is horizontal, and a second portion 240 that is ramped relative to the first portion 235. In other words, the first portion 235 does not have an elevation change and the second portion 240 has the change in elevation 230*a*. In the construction illustrated in FIG. 9, the first portion 235 of the first pin surface 225 is planar and the second portion 240 of the first pin surface 225 is planar such that the change in elevation 230 of the second portion 240 is constant over the length of the second portion 240. In some constructions, the tip of the key 25 can be milled such that the first portion 235 includes a small ramp (i.e., a non-horizontal access surface on the first portion 235) for receiving the auxiliary pin 115 upon initial insertion of the key 25 into the key slot 90.

The second pin groove 215 extends in the direction of the longitudinal axis 165 on the first lateral side 180 and has substantially the same length as the first pin groove 210. Generally, the length of the second pin groove can be varied to alter the locking characteristics of the key and lock cylinder combination.

The second pin groove 215 defines a second blade surface 245 and a second pin surface 250. The second blade surface 245 extends vertically on the first lateral side 180 and is oriented to face outward from the blade 160. The second pin surface 250 is perpendicular to the second blade surface 245 and is oriented to face the bottom 175 of the blade 160, and extends in the direction of the longitudinal axis 165 such that the first pin surface 225 and the second pin surface 250 face in opposite directions. The second pin surface 250 has a change in elevation 230b when the longitudinal axis 165 is horizontal (i.e., the change in elevation 230b is an increase in elevation toward the bow 155). As shown in FIG. 9, the second pin surface 250 is parallel to the first pin surface 225. In other constructions, the second pin surface 250 may be non-parallel relative to the first pin surface 225. Generally, the change in elevation 230*b* of the second pin surface 250 means that along the length of the second pin surface 250 from the tip of the key 25 toward the bow 155, the second pin surface 250 moves closer to the top 170 of the key 25. In other words, the second pin surface 250 is closer to the top 170 of the key 25 after the change in elevation 230*b*. The change in elevation 230*b* corresponds to the change in elevation 230*a* associated with the first pin surface 225 and is separated from the first pin surface 225 based on the distance between the first and second projections 135, 140 of the auxiliary pin 115.

The second pin surface 250 includes a first portion 255 that is horizontal, and a second portion 260 that is ramped relative to the first portion 255. In other words, the first portion 255 has no elevation change and the second portion 260 has the change in elevation 230*b*. In the construction illustrated in FIG. 9, the first portion 255 of the second pin surface 250 is planar and the second portion 260 of the second pin surface 250 is planar such that the change in elevation 230*b* is constant over the length of the second portion 240. In this construction, the first portions 235, 255 of the respective first and second pin surfaces 225, 250 are parallel to each other, and the second portions 240, 260 of the respective first and second pin surfaces 225, 250 are parallel to each other. In other constructions, one or both of the first portions 235, 255 and the second portions 240, 260 of the respective first and second pin surfaces 225, 250 may be non-parallel relative to each other.

The lock cylinder 10 is assembled by inserting the inner pins 105 into the inner pin chambers 95 from adjacent a top of the plug 20 (FIG. 5), and inserting the auxiliary pin 115 into the auxiliary pin chamber 110 from adjacent a bottom of the plug 20 (FIG. 6). The plug 20 is then inserted into the housing 15 after the inner pins 105 and the auxiliary pin 115 have been positioned in the plug 20. The outer pins 100 are positioned in the outer pin chambers 65 after the plug 20 has been assembled and inserted into the housing 15. The springs 102 are inserted into the pin portion 35 after insertion of the outer pins 100 to bias the outer pins 100 and the inner pins 105 inward such that the outer pins 100 partially extend into the inner pin chambers 95. Assembly of the remaining components of the lock cylinder 10 is well known to those skilled in the art.

FIG. 12 shows the lock cylinder 10 without a key in the key slot 90. Without a key in the key slot 90, the auxiliary pin 115 is in the projecting position such that the second end 131 of the auxiliary pin 115 is disposed in the second passageway 45 and is engageable with the housing 15 to prevent rotation of the plug 20 relative to the housing 15. The second projection 140 is positioned at the bottom of the key slot 90 and rests on the wall 30 to limit downward movement of the auxiliary pin 115 through the housing 15 and the plug 20. The second end 131 of the auxiliary pin 115 is engaged with the housing 15 within the second passageway 45 in response to partial rotation of the plug 20.

FIGS. 13 and 14 show the lock cylinder 10 with the key 25 (a proper or correct key) inserted into the key slot 90 and the auxiliary pin 115 in the withdrawn position. The pin engaging portions 205 of the key 25 are engaged with each of the inner pins 105 to move the outer pins 100 to the shear line 87. Once the outer pins 100 are moved to the shear line 87, the plug 150 can be rotated between locked and unlocked positions.

Figure 15:
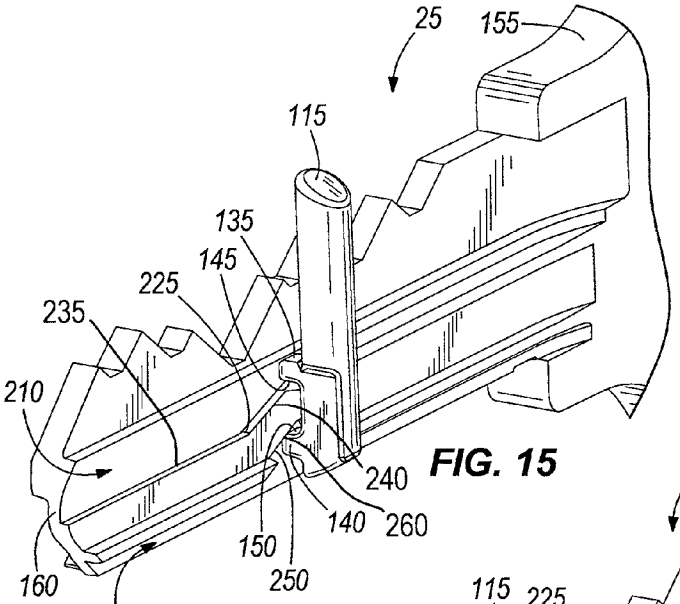
FIG. 15 is a perspective view of the key and the auxiliary pin.
Figure 16:
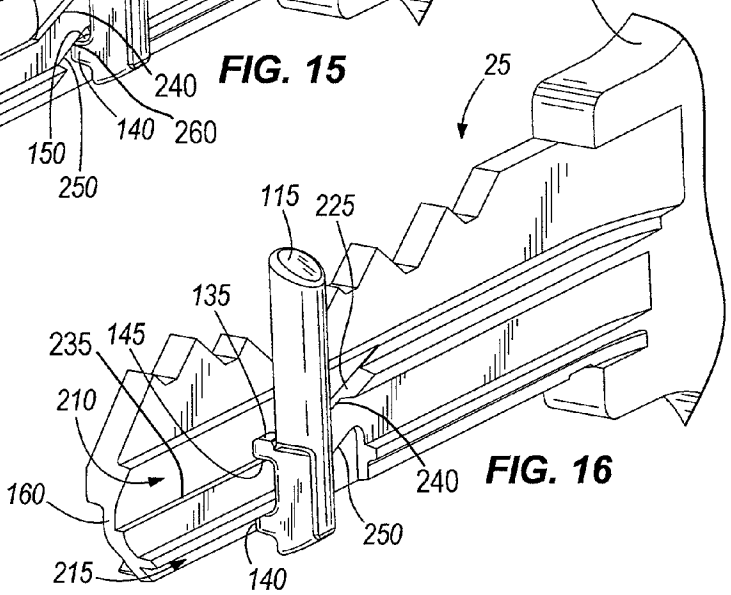
FIG. 16 is another perspective view of the key and the auxiliary pin.

When the key 25 is inserted in the key slot 90, the first engagement surface 145 is engaged by the first pin surface 225 to move the auxiliary pin 115 to the withdrawn position to allow rotation of the plug 20 relative to the housing 15. FIGS. 15 and 16 show that as the key 25 is inserted into the key slot 90, the first engagement surface 145 slides on the first pin surface 225 to move the auxiliary pin 115 to the withdrawn position (FIG. 13). FIG. 16 shows that the first projection 135, and therefore the auxiliary pin 115, slides on the first portion 235 without vertical movement. FIG. 15 shows that the auxiliary pin 115 moves upward toward the top 170 of the key 25 as the first projection 135 slides on the second portion 240 during insertion of the key 25 into the key slot 90 due to the change in elevation 230*a* of the first pin surface 225. The change in elevation 230*a* moves the auxiliary pin 115 upward so that when the key 25 is fully inserted into the key slot 90, the auxiliary pin 115 is in the withdrawn position.

As shown in FIG. 14, the location of the change in elevation 230*a* corresponds to the upward movement necessary for the auxiliary pin 115 to reach the withdrawn position without moving the upper portion 125 of the auxiliary pin 115 into the first passageway 40. Therefore, the lengths of the first pin 210 groove and the second pin groove 215 depend at least in part on the location of the auxiliary pin 115 within the plug 20. In the illustrated construction, the auxiliary pin 115 is located between the third and fourth inner pins 100, and the locations and elevation changes of the changes in elevation 230*a*, 230*b* correspond to the location of the auxiliary pin 115 and the elevation change necessary to move the auxiliary pin 115 to the withdrawn position, respectively. As shown in FIG. 13, when the auxiliary pin 115 is in the withdrawn position, the plug 20 can be rotated relative to the housing 15.

When the key 25 is removed from the key slot 90, the second engagement surface 150 is engaged by the second pin surface 250 to move the auxiliary pin 115 to the projecting position in which the auxiliary pin 115 projects from the plug 20 and is engageable with the housing 15 within the second passageway 45 to prevent rotation of the plug 20 relative to the housing 15. As the key 25 is removed from the key slot 90, the second engagement surface 150 is engaged by and at least initially slides on the second pin surface 250 (FIG. 15). In the illustrated construction, the first engagement surface 145 then slides on the remainder of the first pin surface 225 during removal of the key 25 after the second engagement surface 150 is initially engaged by the second pin surface 250. Alternatively, the auxiliary pin 115 may slide on the first pin surface 225 without initially sliding on the second pin surface 250 (e.g., when the force of gravity overcomes frictional resistance between the plug 20, the auxiliary pin chamber 110, and the auxiliary pin 115).

As shown in FIG. 15, the auxiliary pin 115 moves downward to the projecting position on one or both of the second portions 240, 260 along the changes in elevation 230*a*, 230*b*. As shown in FIG. 16, the auxiliary pin 115 then slides along the first portion 235 of the first pin surface 225 until the key 25 is removed from the key slot 90. When the key 25 is completely removed from the key slot 90, the auxiliary pin 115 is returned to the projecting position. As a corollary to the concept that the changes in elevation 230*a*, 230*b* correspond to the upward movement necessary for the auxiliary pin 115 to reach the withdrawn position, the changes in elevation 230*a*, 230*b* correspond to the downward movement necessary for the auxiliary pin 115 to reach the projecting position. As shown in FIG. 12, when the auxiliary pin 115 is in the projecting position, rotation of the plug 20 relative to the housing 15 is prevented.

FIG. 17 shows the auxiliary pin 115 in a bumped position after being bumped by an inappropriate key or other improper or subversive tool (not shown). Due to the through-hole nature of the first and second passageways 40, 45 and the auxiliary pin chamber 110, the auxiliary pin 115 is movable upward and downward such that the auxiliary pin 115 can engage two different portions of the shear line 87 depending on the direction of movement. In the bumped position, the auxiliary pin 115 projects upward (as viewed in FIG. 17) into the first passageway 40 of the housing 15 such that the upper portion 125 of the auxiliary pin 115 is engageable with the housing 15 to prevent rotation of the plug 20 relative to the housing 15.

Although the invention is described in detail below with regard to the lock cylinder 10 and the key 25, one of ordinary skill in the art will recognize that other lock cylinders and keys are within the scope of the invention.

For example, FIGS. 18A-18E show alternative keys 265*a-e* embodying the invention. Except as described below, the keys 265*a-e* are similar to and function the same as the key 25, and common elements have the same reference numerals.

Figure 18A:
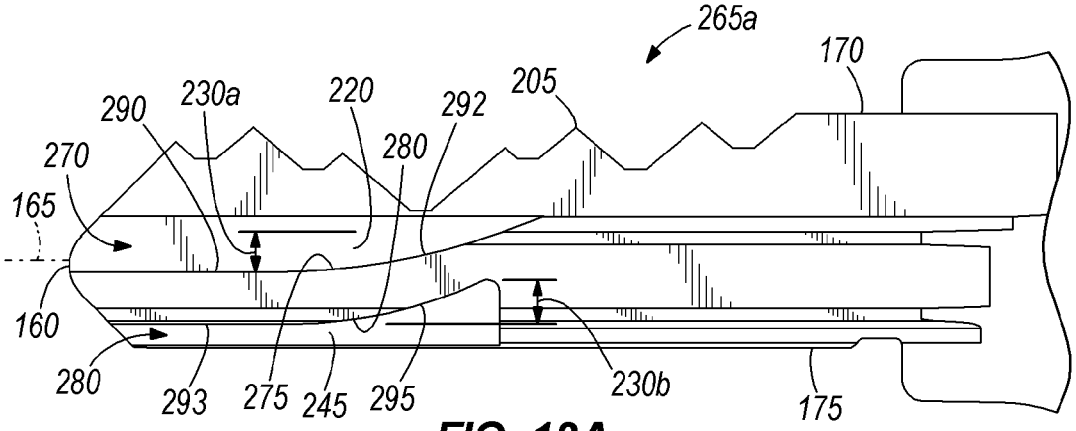
FIG. 18A is a side view of another key for use with the lock cylinder of FIG. 1.

FIG. 18A shows that the key 265*a* includes a first pin groove 270 defining a first pin surface 275 and a second pin groove 280 defining a second pin surface 285. The first pin surface 275 includes a first portion 290 and a second portion 292, and the second pin surface 285 includes a first portion 293 and a second portion 295. Each of the first portions 290, 292 is horizontal and each of the second portions 293, 295 is curved such that the respective changes in elevation 230*a*, 230*b* are non-planar or curvilinear. As shown in FIG. 18A, the first pin surface 275 and the second pin surface 285 are parallel to each other.

Figure 18B:
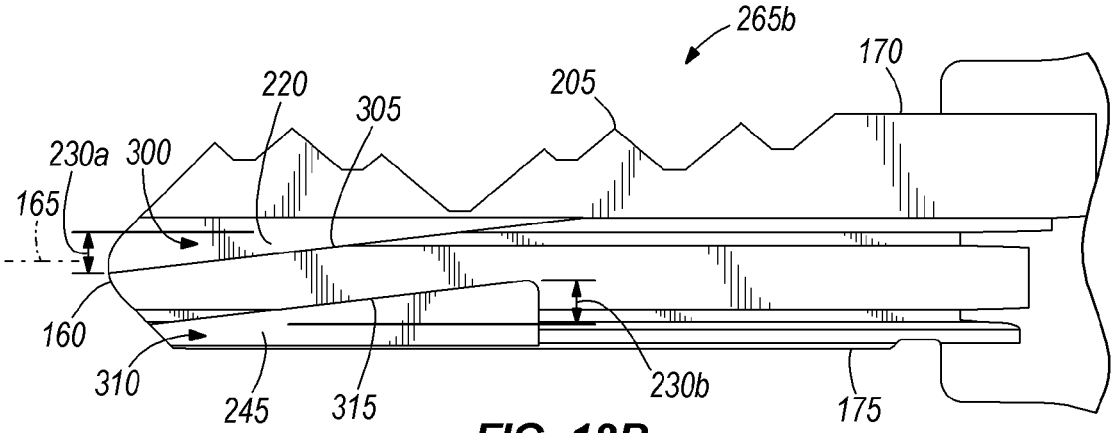
FIG. 18B is a side view of another key for use with the lock cylinder of FIG. 1.

FIG. 18B shows that the key 265*b* includes a first pin groove 300 defining a first pin surface 305 and a second pin groove 310 defining a second pin surface 315. Each of the first and second pin surfaces 305, 315 are planar such that the respective changes in elevation 230*a*, 230*b* are constant and extend over the length of the first and second pin surfaces 305, 315. As shown in FIG. 18B, the first pin surface 275 and the second pin surface 285 are parallel to each other.

Figure 18C:
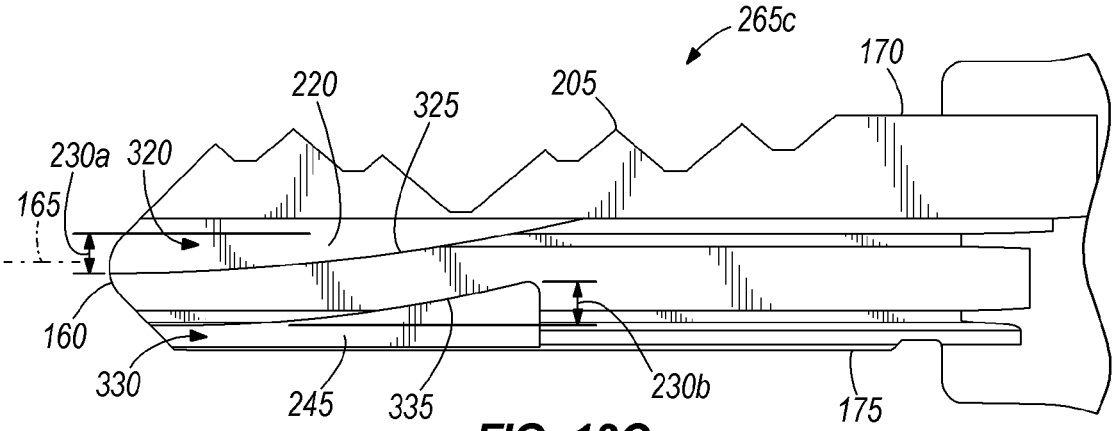
FIG. 18C is a side view of another key for use with the lock cylinder of FIG. 1.

FIG. 18C shows that the key 265*c* includes a first pin groove 320 defining a first pin surface 325 and a second pin groove 330 defining a second pin surface 335. Each of the first and second pin surfaces 325, 335 are curved such that the respective changes in elevation 230*a*, 230*b* are non-planar or curvilinear and extend over the length of the first and second pin surfaces 325, 335. As shown in FIG. 18C, the first pin surface 325 and the second pin surface 335 are parallel to each other.

Figure 18D:
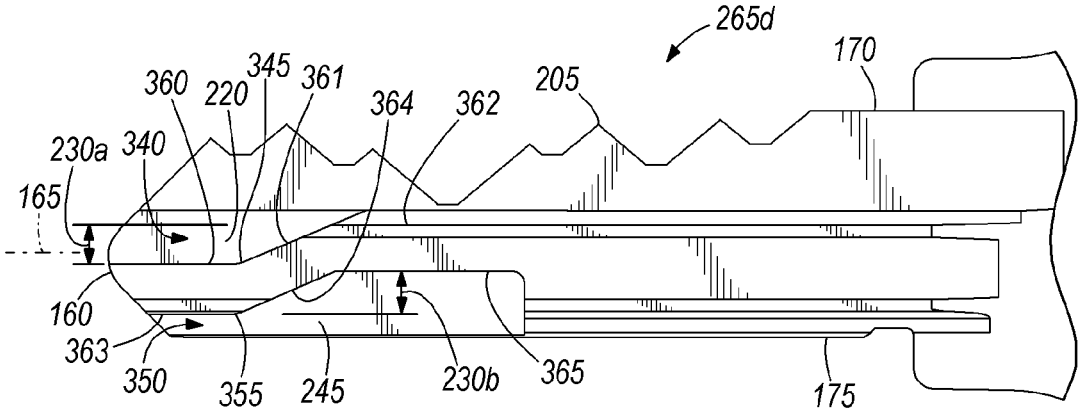
FIG. 18D is a side view of another key for use with the lock cylinder of FIG. 1.

FIG. 18D shows that the key 265*d* includes a first pin groove 340 defining a first pin surface 345 and a second pin groove 350 defining a second pin surface 355. The first pin surface 345 includes a first portion 360, a second portion 361, and a third portion 362. The second pin surface 355 includes a first portion 363, a second portion 364, and a third portion 365. Each of the second portions 361, 364 is located adjacent a middle of the respective first and second pin grooves 340, 350, and is ramped relative to the associated first portion 360, 363 and the associated third portion 362, 365. Each of the first portions 360, 363 and each of the respective third portions 362, 365 is horizontal, and each of the second portions 361, 364 is planar such that the respective changes in elevation 230*a*, 230*b* are constant. As shown in FIG. 18D, the first pin surface 275 and the second pin surface 285 are parallel to each other.

Figure 18E:
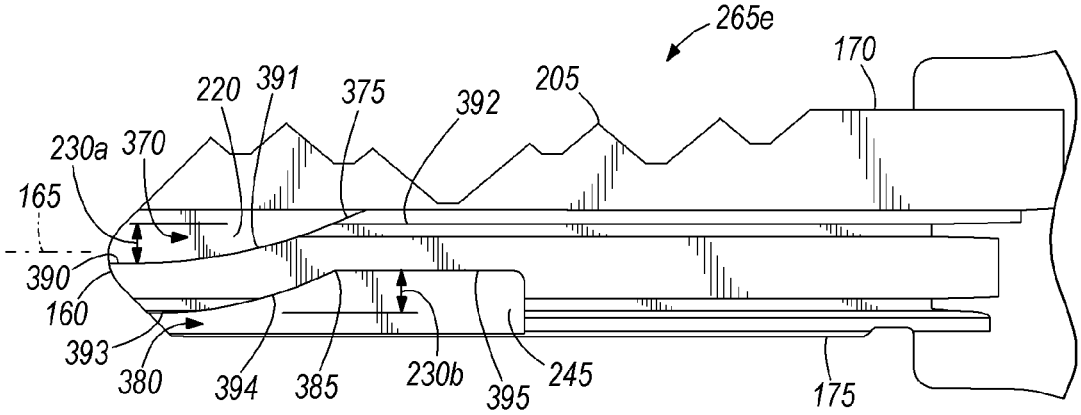
FIG. 18E is a side view of another key for use with the lock cylinder of FIG. 1.

FIG. 18E shows that the key 265*e* includes a first pin groove 370 defining a first pin surface 375 and a second pin groove 380 defining a second pin surface 385. The first pin surface 375 includes a first portion 390, a second portion 391, and a third portion 392. The second pin surface 385 includes a first portion 393, a second portion 394, and a third portion 395. Each of the second portions 391, 394 is located adjacent a middle of the respective first and second pin grooves 370, 380, and is ramped relative to the associated first portion 390, 393 and the associated third portion 392, 395. Each of the first portions 390, 393 and each of the third portions 362, 365 is horizontal, and each of the second portions 361, 364 is curved such that the respective changes in elevation 230*a*, 230*b* are curvilinear. As shown in FIG. 18E, the first pin surface 275 and the second pin surface 285 are parallel to each other.

Although various constructions of keys for the lock cylinder 10 have been described herein, one of ordinary skill in the art will recognize that keys including other changes in elevation are possible and within the scope of the invention. For example, changes in elevation on a key may be located adjacent the tip of the key. Furthermore, more than one change in elevation may be provided on a key, either toward a top of the key, toward a bottom of the key, or both (e.g., stepped changes in elevation).

Figure 19:
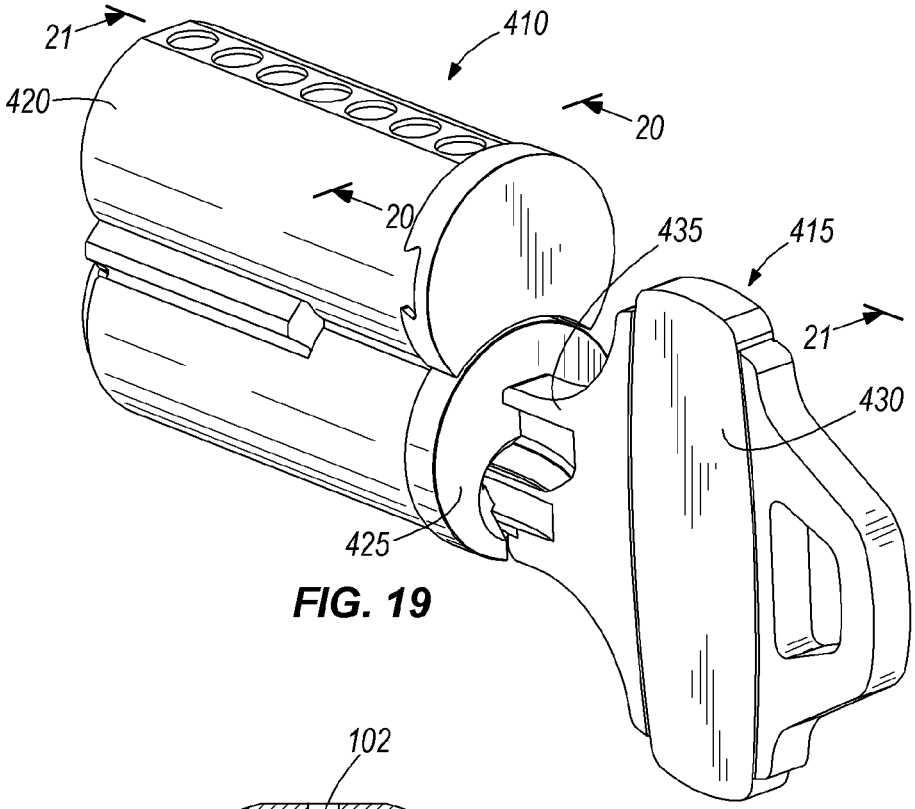
FIG. 19 is a perspective view of another lock cylinder embodying the invention.
Figure 20:
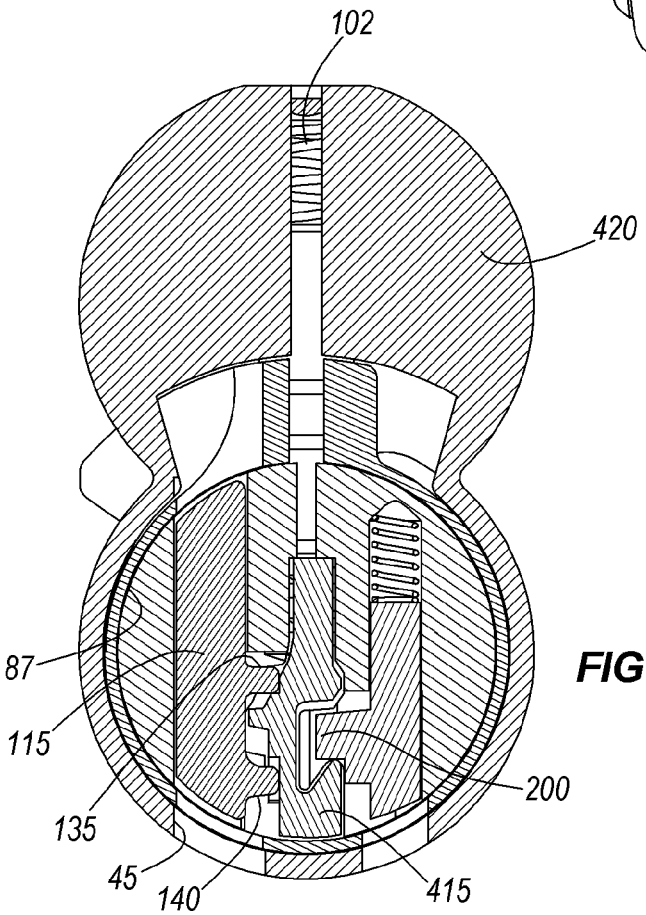
FIG. 20 is a section view of the lock cylinder taken along line 20-20 in FIG. 19.
Figure 21:
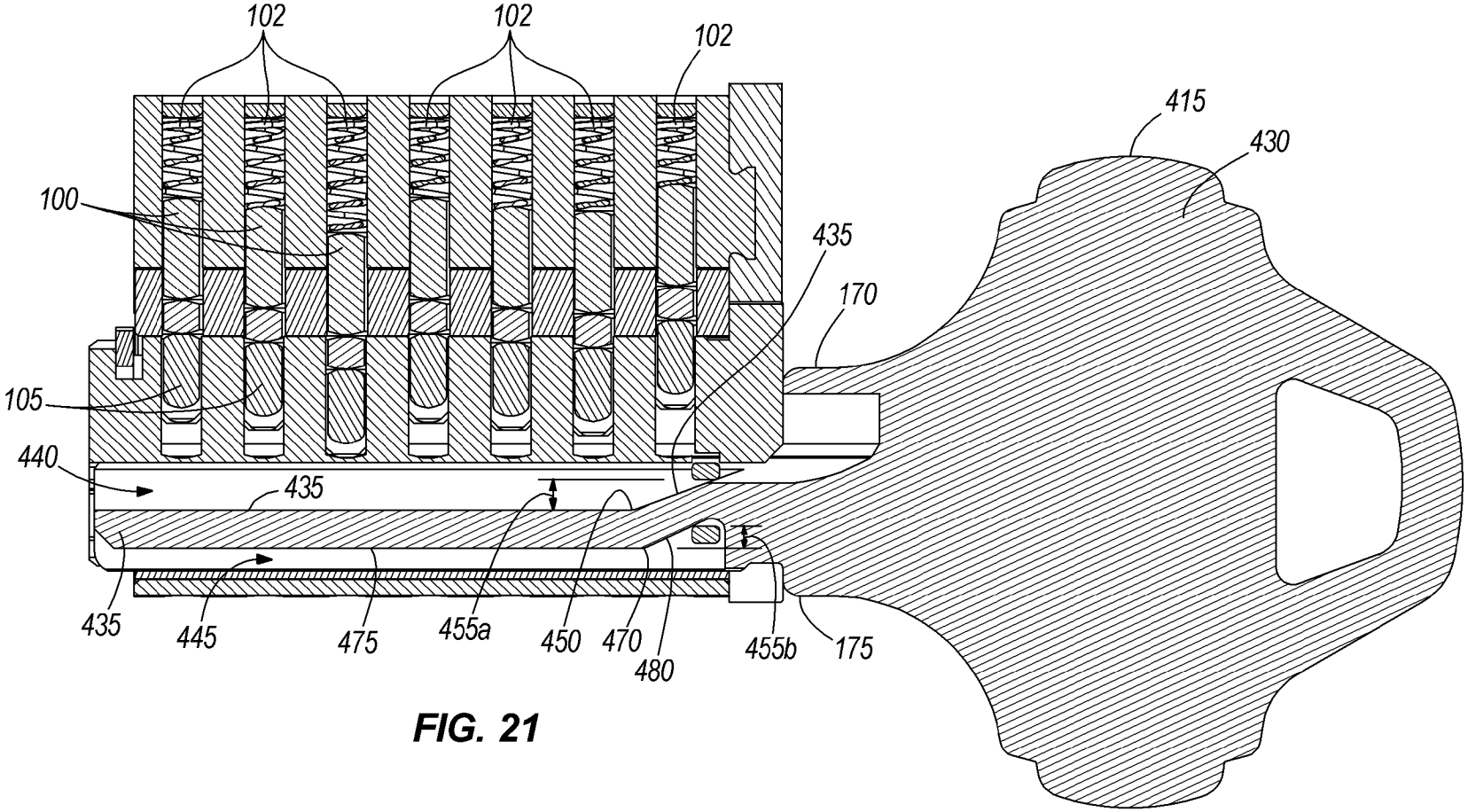
FIG. 21 is another section view of the lock cylinder taken along line 21-21 in FIG. 19.

By way of illustration, the invention described herein is applicable to and usable with other lock cylinders. For example, FIGS. 19-21 show another construction of a lock cylinder 410 and a key 415 for use with the door. The lock cylinder 410 is an interchangeable core ("IC") lock cylinder including an IC housing 420 and a plug 425 that is lockable and unlockable using the key 415. Except as described below, the lock cylinder 410 is similar to the lock cylinder 10 described with regard to FIGS. 1-17 and the key 415 is similar to the key 425, and common elements are given the same reference numerals.

FIGS. 19-21 show how the invention described herein can be used with an interchangeable core lock cylinder. One of ordinary skill in the art will recognize the features and elements of the IC lock cylinder 410, and as such, these features will not be described in detail.

As shown in FIGS. 20 and 21, the key 415 includes a bow 430 that is similar to the bow 155 and a blade 435 that is similar to the blade 160 described with regard to FIGS. 8-11B. The blade 435 includes a first pin groove 440 and a second pin groove 445 that extend in the direction of the longitudinal axis a substantial length of the blade 435 without extending the full length of the blade 435. As shown in FIG. 21, the first pin groove 440 and the second pin groove 445 are formed in the first lateral side 180.

The first pin groove 440 defines a first pin surface 450 that is oriented to face the top 170 of the blade 440. The first pin surface 450 extends in the direction of the longitudinal axis 165 and has a change in elevation 455*a* when the longitudinal axis 165 is horizontal. As shown in FIG. 21, the first pin surface 450 includes a first portion 460 that is horizontal, and a second portion 465 that is ramped relative to the first portion 460 to define the change in elevation 455*a*.

The second pin groove 445 defines a second pin surface 470 that is oriented to face the bottom 175 of the blade 435 such that the first pin surface 450 and the second pin surface 470 face in opposite directions. The second pin surface 470 extends in the direction of the longitudinal axis 165 and has a change in elevation 455*b* when the longitudinal axis 165 is horizontal. FIG. 21 shows that the second pin surface 470 includes a first portion 475 that is horizontal, and a second portion 480 that is ramped relative to the first portion 475 to define the change in elevation 455*b*. As shown in FIG. 21, each of the first portions 460, 475 is planar and each of the second portions 465, 480 is planar such that the changes in elevation 455*a*, 455*b* are constant. In the illustrated construction, the second pin surface 470 is parallel to the first pin surface 450, and the change in elevation 455*b* corresponds to the change in elevation 455*a* associated with the first pin surface 450.

Various features and advantages of the invention are set forth in the following claims.

The invention claimed is:

1. A key and lock cylinder combination comprising:

a key including a bow and a blade extending from and connected to the bow, the blade defining a longitudinal axis along the length of the blade and defined by a first lateral side and a second lateral side opposite the first lateral side, the blade having pin engaging portions at a top of the blade, a first pin groove on the first lateral side extending in the direction of the longitudinal axis and defining a first pin surface, and a second pin groove on the first lateral side extending in the direction of the longitudinal axis and defining a second pin surface, at least a portion of one or both of the first pin surface and the second pin surface being planar, the first pin surface oriented to face the top of the blade and the second pin surface oriented to face a bottom of the blade such that the first pin surface and the second pin surface face in opposite directions, each of the first pin surface and the second pin surface having a first portion and a second portion;

a housing including a wall defining a hollow portion, and a pin portion defining an outer pin chamber;

an outer pin disposed in the outer pin chamber;

a plug including a body rotatably housed within the hollow portion of the housing, the housing and the plug cooperating to define a shear line, the plug defining a key slot extending at least partially through the body in a longitudinal direction of the plug, the plug further defining an inner pin chamber disposed within the body and in communication with the key slot and selectively aligned with the outer pin chamber, and an auxiliary pin chamber in communication with the key slot;

an inner pin disposed in the inner pin chamber and extending partially into the key slot such that the inner pin is engageable by the pin engaging portions; and an auxiliary pin disposed in the auxiliary pin chamber and in communication with the key slot, the auxiliary pin including a first projection defining a first engagement surface engageable by the first pin surface when the key is inserted into the key slot to move the auxiliary pin to a withdrawn position to allow rotation of the plug relative to the housing, and a second projection spaced apart from the first projection and defining a second engagement surface generally facing the first engagement surface and engageable by the second pin surface when the key is removed from the key slot to move the auxiliary pin to a projecting position in which the auxiliary pin projects from the plug and is engageable with the housing to prevent rotation of the plug relative to the housing, wherein each of the first portions has no elevation change and each of the second portions has a planar increase in elevation toward the bow when the longitudinal axis is horizontal such that the auxiliary pin is movable upward upon insertion of the key into the key slot, and movable downward upon removal of the key from the key slot.

2. The key and lock cylinder combination of claim 1, wherein each of the first projection and the second projection has a substantially rectangular cross-section, and wherein each of the first engagement surface and the second engagement surface is substantially planar.

3. The key and lock cylinder combination of claim 1, wherein the auxiliary pin includes a substantially cylindrical upper portion and a lower planar portion.

4. The key and lock cylinder combination of claim 1, wherein the first engagement surface is slidable on the first pin surface to move the auxiliary pin to the withdrawn position, and wherein the second engagement surface is slidable along the second pin surface to move the auxiliary pin to the projecting position upon removal of the key from the key slot.

5. The key and lock cylinder combination of claim 1, wherein the first portions and the second portions are planar.

6. The key and lock cylinder combination of claim 1, wherein the first portion of the first pin surface and the first portion of the second pin surface are parallel to each other, and wherein the second portion of the first pin surface and the second portion of the second pin surface are parallel to each other.

7. The key and lock cylinder combination of claim 1, wherein the increase in elevation of at least one or both of the first pin surface and the second pin surface is non-planar.

8. The key and lock cylinder combination of claim 7, wherein each of the first pin surface and the second pin surface has a first portion and a second portion, and wherein each of the first portions has no elevation change and each of the second portions has the non-planar increase in elevation.

9. The key and lock cylinder combination of claim 1, wherein at least one of the first pin surface and the second pin surface has a constant increase in elevation over the length of the associated pin surface.

10. The key and lock cylinder combination of claim 1, wherein each of the first pin groove and the second pin groove has a length that is shorter than the length of the blade.

11. The key and lock cylinder combination of claim 1, wherein the auxiliary pin is unbiased and movable by the key without a spring force.

12. The key and lock cylinder combination of claim 1, wherein the plug includes two inner pin chambers, and wherein the auxiliary pin chamber is offset from the key slot in a lateral direction of the plug and between the two inner pin chambers.

13. The key and lock cylinder combination of claim 1, further comprising a biasing member positioned to bias the auxiliary pin against the key.

14. The key and lock cylinder combination of claim 1, further comprising a second auxiliary pin disposed in a second auxiliary pin chamber positioned on the opposite side of the key as the auxiliary pin.

15. A key and lock cylinder combination comprising:

a key including a bow and a blade extending from and connected to the bow, the blade defining a longitudinal axis along the length of the blade and defined by a first lateral side and a second lateral side opposite the first lateral side, the blade having pin engaging portions at a top of the blade, a first pin surface extending in the direction of the longitudinal axis on the first lateral side, and a second pin surface extending in the direction of the longitudinal axis on the first lateral side, the first pin surface and the second pin surface oriented to face in opposite directions, and each of the first pin surface and the second pin surface having an increase in elevation at respective ends of the first and second pin surfaces adjacent the bow when the longitudinal axis is horizontal;

a housing including a wall defining a hollow portion, and a pin portion defining an outer pin chamber;

an outer pin disposed in the outer pin chamber;

a plug including a body rotatably housed within the hollow portion of the housing, the housing and the plug cooperating to define a shear line, the plug defining a key slot extending at least partially through the body in a longitudinal direction of the plug, the plug further defining an inner pin chamber disposed within the body and in communication with the key slot and selectively aligned with the outer pin chamber, and an auxiliary pin chamber in communication with the key slot and offset from the key slot;

an inner pin disposed in the inner pin chamber and extending into the key slot such that the inner pin is engageable by the pin engaging portions; and an auxiliary pin disposed in the auxiliary pin chamber and in communication with the key slot and engaged by the first pin surface upon insertion of the key into the key slot to move the auxiliary pin to a withdrawn position to allow rotation of the plug relative to the housing, the auxiliary pin also engaged by the second pin surface upon removal of the key from the key slot to move the auxiliary pin to a projecting position in which the auxiliary pin projects from the plug and is engageable with the housing to prevent rotation of the plug relative to the housing.

16. The key and lock cylinder combination of claim 15, wherein the auxiliary pin includes a first engagement surface engageable by the first pin surface when the key is inserted into the key slot to move the auxiliary pin to the withdrawn position, and a second engagement surface engageable by the second pin surface when the key is removed from the key slot to move the auxiliary pin to the projecting position, and wherein the first engagement surface and the second engagement surface face each other.

17. The key and lock cylinder combination of claim 16, wherein the auxiliary pin includes a first projection defining the first engagement surface, and a second projection spaced apart from the first projection and defining the second engagement surface.

18. The key and lock cylinder combination of claim 17, wherein each of the first engagement surface and the second engagement surface is substantially planar.

19. The key and lock cylinder combination of claim 17, wherein the auxiliary pin includes a substantially cylindrical upper portion and a lower planar portion.

20. The key and lock cylinder combination of claim 16, wherein the first engagement surface is slidable on the first pin surface to move the auxiliary pin to the withdrawn position, and wherein the second engagement surface is slidable along the second pin surface to move the auxiliary pin to the projecting position upon removal of the key from the key slot.

21. The key and lock cylinder combination of claim 15, wherein the first pin surface is oriented to face upward toward the top of the blade, and the second pin surface is oriented to face downward toward a bottom of the blade.

22. The key and lock cylinder combination of claim 15, wherein at least a portion of one or both of the first pin surface and the second pin surface is planar.

23. The key and lock cylinder combination of claim 22, wherein each of the first pin surface and the second pin surface has a first portion and a second portion, and wherein the first portion has no elevation change and the second portion has a planar increase in elevation.

24. The key and lock cylinder combination of claim 23, wherein the first portions and the second portions are planar.

25. The key and lock cylinder combination of claim 23, wherein the first portion of the first pin surface and the first portion of the second pin surface are parallel to each other, and wherein the second portion of the first pin surface and the second portion of the second pin surface are parallel to each other.

26. The key and lock cylinder combination of claim 15, wherein the increase in elevation of at least one or both of the first pin surface and the second pin surface is non-planar.

27. The key and lock cylinder combination of claim 26, wherein each of the first pin surface and the second pin surface has a first portion and a second portion, and wherein each of the first portions has no elevation change and each of the second portions has the non-planar increase in elevation.

28. The key and lock cylinder combination of claim 15, wherein at least one of the first pin surface and the second pin surface has a constant increase in elevation over the length of the associated pin surface.

29. The key and lock cylinder combination of claim 15, wherein each of the first pin surface and the second pin surface has a length that is shorter than the length of the blade.

30. The key and lock cylinder combination of claim 15, wherein the auxiliary pin is unbiased and movable by the key without a spring force.

31. The key and lock cylinder combination of claim 15, wherein the plug includes two inner pin chambers, and wherein the auxiliary pin chamber is offset from the key slot in a lateral direction of the plug and between the two inner pin chambers.

32. The key and lock cylinder combination of claim 15, further comprising a biasing member positioned to bias the auxiliary pin against the key.

33. The key and lock cylinder combination of claim 15, further comprising a second auxiliary pin disposed in a second auxiliary pin chamber positioned on the opposite side of the key as the auxiliary pin.

34. A lock cylinder comprising:

a housing including a wall defining a hollow portion, and a pin portion defining at least two outer pin chambers;

outer pins disposed in each of the outer pin chambers;

a plug including a body rotatably housed within the hollow portion of the housing, the housing and the plug cooperating to define a shear line, the plug defining a key slot extending at least partially through the body in a longitudinal direction of the plug, the plug further defining at least two inner pin chambers disposed within the body and in communication with the key slot and selectively aligned with the outer pin chambers, and an auxiliary pin chamber in communication with the key slot;

inner pins disposed in each of the inner pin chambers and extending partially into the key slot such that the inner pins are engageable by a key; and an auxiliary pin disposed in the auxiliary pin chamber and in communication with the key slot, the auxiliary pin including a substantially cylindrical upper portion and a lower planar portion, the auxiliary pin further including a first projection defining a first engagement surface engageable by a key to move the auxiliary pin to a withdrawn position to allow rotation of the plug relative to the housing, and a second projection spaced apart from the first projection and defining a second engagement surface generally facing the first engagement surface and engageable by the key to move the auxiliary pin to a projecting position in which the auxiliary pin projects from the plug and is engageable with the housing to prevent rotation of the plug relative to the housing.

35. The lock cylinder of claim 34, wherein each of the first projection and the second projection has a substantially rectangular cross-section, and wherein each of the first engagement surface and the second engagement surface is substantially planar.

36. The lock cylinder of claim 34, wherein the auxiliary pin is unbiased and movable without a spring force.

37. The lock cylinder of claim 34, wherein the auxiliary pin chamber is offset from the key slot in a lateral direction of the plug and between the two inner pin chambers.

38. The lock cylinder of claim 34, wherein the first projection is slidable on a proper key to move the auxiliary pin to the withdrawn position, and wherein the second projection is slidable on the proper key to move the auxiliary pin to the projecting position.

39. The lock cylinder of claim 34, wherein the auxiliary pin is engaged with the housing in the projecting position, and wherein the auxiliary pin is disengaged from the housing in the withdrawn position.

40. The lock cylinder of claim 34, wherein the housing includes a first passageway offset from the pin portion and extending through the wall of the housing, and a second passageway opposite the first passageway, and wherein the first passageway and the second passageway are in communication with the auxiliary pin chamber after assembly of the plug into the housing.

41. The lock cylinder of claim 40, wherein the auxiliary pin is engaged with the housing within the first passageway to inhibit rotation of the plug relative to the housing in response to bumping of the inner pins and the auxiliary pin by an improper key.

42. The lock cylinder of claim 40, wherein the auxiliary pin is disengaged from the housing in the withdrawn position to allow rotation of the plug relative to the housing.

43. The lock cylinder of claim 40, wherein the auxiliary pin is engaged with the housing within the second passageway in the projecting position to inhibit rotation of the plug in the absence of a key in the key slot.

44. The lock cylinder of claim 34, wherein the housing and the plug form an interchangeable core lock cylinder.

45. The lock cylinder of claim 34, further comprising a biasing member positioned to bias the auxiliary pin against the key.

46. The lock cylinder of claim 34, further comprising a second auxiliary pin disposed in a second auxiliary pin chamber positioned on the opposite side of the key as the auxiliary pin.

47. A key for a lock cylinder, the key comprising:

a bow; and a blade extending from and connected to the bow, the blade defining a longitudinal axis along the length of the blade and defined by a first lateral side and a second lateral side opposite the first lateral side, the blade having pin engaging portions at a top of the blade, a first pin groove extending in the direction of the longitudinal axis on the first lateral side and defining a first pin surface, and a second pin groove extending in the direction of the longitudinal axis on the first lateral side and defining a second pin surface, the first pin surface oriented to face the top of the blade and the second pin surface oriented to face a bottom of the blade such that the first pin surface and the second pin surface face in opposite directions, and each of the first pin surface and the second pin surface engageable with a pin of the lock cylinder to move the pin between a withdrawn position and a projecting position, wherein each of the first pin surface and the second pin surface has an increase in elevation toward the bow when the longitudinal axis is horizontal such that the pin is movable upward upon insertion of the key into the lock cylinder, and the pin is movable downward upon removal of the key from the lock cylinder.

48. The key of claim 47, wherein at least a portion of one or both of the first pin surface and the second pin surface is planar.

49. The key of claim 48, wherein each of the first pin surface and the second pin surface has a first portion and a second portion, and wherein the first portion has no change in elevation and the second portion has a planar increase in elevation.

50. The key of claim 49, wherein the first portions and the second portions are planar.

51. The key of claim 50, wherein the first portion of the first pin surface and the first portion of the second pin surface are parallel to each other, and wherein the second portion of the first pin surface and the second portion of the second pin surface are parallel to each other.

52. The key of claim 47, wherein the increase in elevation of at least one or both of the first pin surface and the second pin surface is non-planar.

53. The key of claim 52, wherein each of the first pin surface and the second pin surface has a first portion and a second portion, and wherein each of the first portions has no elevation change and each of the second portions has the non-planar increase in elevation.

54. The key of claim 47, wherein at least one of the first pin surface and the second pin surface has a constant increase in elevation over the length of the associated pin surface.

55. The key of claim 47, wherein each of the first pin groove and the second pin groove has a length that is shorter than the length of the blade.

56. A key for a lock cylinder, the key comprising:

a bow; and a blade extending from and connected to the bow, the blade defining a longitudinal axis along the length of the blade and defined by a first lateral side and a second lateral side opposite the first lateral side, the blade having pin engaging portions at a top of the blade, a first pin surface extending in the direction of the longitudinal axis on the first lateral side and oriented to face the top of the blade, and a second pin surface extending in the direction of the longitudinal axis on the first lateral side and oriented to face a bottom of the blade such that the first pin surface and the second pin surface face in opposite directions, each of the first pin surface and the second pin surface having an increase in elevation at respective ends of the first and second pin surfaces adjacent the bow when the longitudinal axis is horizontal such that a pin of the lock cylinder is movable to a withdrawn position upon insertion of the key into the lock cylinder, and movable to a projecting position upon removal of the key from the lock cylinder.

57. The key of claim 56, wherein at least a portion of one or both of the first pin surface and the second pin surface is planar.

58. The key of claim 57, wherein each of the first pin surface and the second pin surface has a first portion and a second portion, and wherein the first portion has no change in elevation and the second portion has a planar increase in elevation.

59. The key of claim 58, wherein the first portions and the second portions are planar.

60. The key of claim 59, wherein the first portion of the first pin surface and the first portion of the second pin surface are parallel to each other, and wherein the second portion of the first pin surface and the second portion of the second pin surface are parallel to each other.

61. The key of claim 56, wherein the increase in elevation of at least one or both of the first pin surface and the second pin surface is non-planar.

62. The key of claim 61, wherein each of the first pin surface and the second pin surface has a first portion and a second portion, and wherein the first portion has no change in elevation and the second portion has the non-planar increase in elevation.

63. The key of claim 56, wherein at least one of the first pin surface and the second pin surface has a constant increase in elevation over the length of the associated pin surface.

* * * * *